US010772797B2

(12) United States Patent
Denenburg

(10) Patent No.: US 10,772,797 B2
(45) **Date of Patent: *Sep. 15, 2020**

(54) LIQUID DRUG TRANSFER DEVICES FOR USE WITH INTACT DISCRETE INJECTION VIAL RELEASE TOOL

(71) Applicant: West Pharma. Services IL, Ltd., Ra'anana (IL)

(72) Inventor: Igor Denenburg, Gedera (IL)

(73) Assignee: WEST PHARMA. SERVICES IL, LTD., Ra'anana (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/466,422

(22) PCT Filed: Nov. 29, 2017

(86) PCT No.: PCT/IL2017/051299
§ 371 (c)(1),
(2) Date: Jun. 4, 2019

(87) PCT Pub. No.: WO2018/104930
PCT Pub. Date: Jun. 14, 2018

(65) Prior Publication Data

US 2019/0343725 A1 Nov. 14, 2019

(30) Foreign Application Priority Data

Dec. 6, 2016 (IL) ..... 249408

(51) Int. Cl.

| | |
|---|---|
| ***A61J 1/20*** | (2006.01) |
| ***A61J 1/14*** | (2006.01) |
| ***A61J 1/10*** | (2006.01) |

(52) U.S. Cl.
CPC ..... *A61J 1/2096* (2013.01); *A61J 1/10* (2013.01); *A61J 1/1418* (2015.05); *A61J 1/201* (2015.05);
(Continued)

(58) Field of Classification Search
CPC ..... A61J 1/2096; A61J 1/201; A61J 1/2089; A61J 1/2051; A61J 1/2058; A61J 1/1425;
(Continued)

(56) References Cited

U.S. PATENT DOCUMENTS

| | | | |
|---|---|---|---|
| 62,333 | A | 2/1867 | Holl |
| 247,975 | A | 10/1881 | Wickes |

(Continued)

FOREIGN PATENT DOCUMENTS

| | | | |
|---|---|---|---|
| CA | 2946559 | A1 | 10/2015 |
| CN | 1636605 | A | 7/2005 |

(Continued)

OTHER PUBLICATIONS

Int'l Search Report and Written Opinion dated Feb. 16, 2018 in Int'l Application No. PCT/IL2017/051299.

(Continued)

*Primary Examiner* — Ophelia A Hawthorne
*Assistant Examiner* — Alessandro R Del Priore
(74) *Attorney, Agent, or Firm* — Panitch Schwarze Belisario & Nadel LLP

(57) ABSTRACT

Liquid drug transfer devices including an integral telescopic vial adapter for telescoping from an initial pre-compacted state to a final compacted state. In the initial pre-compacted state, the vial adapter telescopically snap fits on an initially non-punctured intact discrete injection vial leaving its injection vial stopper non-punctured. In the final compacted state, the vial adapter punctures the injection vial stopper. The liquid drug transfer device is used with an intact discrete (Continued)

injection vial release tool for applying a pincers-like compression for convenient release of a non-punctured intact discrete injection vial in the initial pre-compacted state. The vial adapter includes a clamping arrangement for irreversibly clamping same in the final compacted state. The vial adapter precludes release of a punctured discrete injection vial in its final compacted state.

8 Claims, 9 Drawing Sheets

(52) U.S. Cl.
CPC ..... *A61J 1/2041* (2015.05); *A61J 1/2058* (2015.05); *A61J 1/2089* (2013.01); *A61J 1/2048* (2015.05)

(58) Field of Classification Search
CPC ..... A61J 1/2003; A61J 1/2004; A61J 1/1406; A61J 1/2055; A61J 1/2065; A61J 1/2048; A61M 5/1782; A61M 2039/1072; A61M 2005/3118; A61M 39/04; A61M 39/10; A61M 5/31511; A61M 5/32; A61M 5/34; A61M 2005/3114; A61M 39/16; A61M 5/162; A61M 5/2033; A61M 5/3137; A61M 5/3202; A61M 5/482; A61M 2005/1787; A61M 2005/3103; A61M 2005/3123; A61M 2005/3128; A61M 2005/3132; A61M 2005/31508; A61M 2039/1077; A61M 39/1011; A61M 39/22; A61M 5/1407; A61M 5/1413; A61M 5/178; A61M 5/19; A61M 5/2448; A61M 5/28; A61M 5/284; A61M 5/31; A61M 5/3129; A61M 5/31513; A61M 5/31596; A61M 5/3293; A61M 5/344; A61M 5/346; A61M 5/348; A61M 19/00; A61M 1/3693; A61M 2005/1623; A61M 2005/247; A61M 2005/3125; A61M 2005/31598; A61M 2005/3241; A61M 2037/0023; A61M 2037/0061; A61M 2039/1033; A61M 2205/3569; A61M 2205/3584; A61M 2205/502; A61M 2205/6009; A61M 2205/6036; A61M 2205/6054; A61M 2207/00; A61M 2209/045; A61M 2210/0612; A61M 37/0015; A61M 39/223; A61M 39/24; A61M 39/26; A61M 5/1408; A61M 5/14566; A61M 5/16822; A61M 5/16827; A61M 5/2053; A61M 5/286; A61M 5/3148; A61M 5/31546; A61M 5/31566; A61M 5/3243; A61M 5/326; A61M 5/347; A61M 5/349; A61M 5/46; A61M 13/003; A61M 15/08; A61M 1/02; A61M 1/029; A61M 1/062; A61M 1/1656; A61M 1/1666; A61M 1/1668; A61M 1/28; A61M 1/287; A61M 2005/006; A61M 2005/2013; A61M 2005/206; A61M 2005/2451; A61M 2005/2474; A61M 2005/3104; A61M 2005/3121; A61M 2005/3126; A61M 2005/3131; A61M 2005/3139; A61M 2005/31518; A61M 2005/3201; A61M 2005/3226; A61M 2005/323; A61M 2005/3231; A61M 2005/3256; A61M 2025/102; A61M 2039/1027; A61M 2039/1038; A61M 2039/1044; A61M 2039/1061; A61M 2039/1094; A61M 2039/229; A61M 2039/2426; A61M 2039/2433; A61M 2039/261; A61M 2039/267; A61M 2039/268; A61M 2202/0208; A61M 2202/0216; A61M 2202/0225; A61M 2202/0482; A61M 2205/3379; A61M 2205/3576; A61M 2205/36; A61M 2205/3606; A61M 2205/50; A61M 2205/60; A61M 2205/6045; A61M 2205/6072; A61M 2205/6081; A61M 2205/75; A61M 2205/7509; A61M 2205/7518; A61M 25/10185; A61M 25/10186; A61M 25/10187; A61M 35/006; A61M 39/00; A61M 39/02; A61M 39/045; A61M 39/08; A61M 39/105; A61M 39/18; A61M 39/20; A61M 39/28; A61M 5/002; A61M 5/007; A61M 5/008; A61M 5/14; A61M 5/1409; A61M 5/1411; A61M 5/14244; A61M 5/1452; A61M 5/168; A61M 5/1684; A61M 5/16881; A61M 5/204; A61M 5/2066; A61M 5/2425; A61M 5/2459; A61M 5/3145; A61M 5/315; A61M 5/31501; A61M 5/31505; A61M 5/31515; A61M 5/321; A61M 5/322; A61M 5/3232; A61M 5/3234; A61M 5/3245; A61M 5/3276; A61M 5/329; A61M 5/3297; A61M 5/3298; A61M 5/36; A61M 5/5066; A61M 5/508; B65D 51/002; B65D 81/3211; B65D 25/02; B65D 51/00; B65D 75/5877; B65D 75/5883; B65D 77/04; B65D 81/3261; B65D 81/3266; B65D 81/3272; B01L 2200/026; B25J 11/008; B25J 9/1679
See application file for complete search history.

(56) References Cited

U.S. PATENT DOCUMENTS

| | | | |
|---|---|---|---|
| 254,444 | A | 2/1882 | Vogel |
| 300,060 | A | 6/1884 | Ford |
| 1,021,681 | A | 3/1912 | Jennings |
| 1,704,817 | A | 3/1929 | Ayers |
| 1,930,944 | A | 10/1933 | Schmitz, Jr. |
| 2,326,490 | A | 8/1943 | Perelson |
| 2,560,162 | A | 7/1951 | Garwood |
| 2,748,769 | A | 6/1956 | Huber |
| 2,830,587 | A | 4/1958 | Everett |
| 2,931,668 | A | 4/1960 | Baley |
| 2,968,497 | A | 1/1961 | Treleman |
| 3,059,643 | A | 10/1962 | Barton |
| D198,499 | S | 6/1964 | Harautuneian |
| 3,225,763 | A | 12/1965 | Waterman |
| 3,277,893 | A | 10/1966 | Clark |
| 3,308,822 | A | 3/1967 | De Luca |
| 3,484,849 | A | 12/1969 | Huebner et al. |
| 3,618,637 | A | 11/1971 | Santomieri |
| 3,757,981 | A | 9/1973 | Harris, Sr. et al. |
| 3,782,365 | A | 1/1974 | Pinna |
| 3,788,524 | A | 1/1974 | Davis et al. |
| 3,822,700 | A | 7/1974 | Pennington |
| 3,826,261 | A | 7/1974 | Killinger |
| 3,872,992 | A | 3/1975 | Larson |
| 3,885,607 | A | 5/1975 | Peltier |
| 3,938,520 | A | 2/1976 | Scislowicz et al. |
| 3,957,052 | A | 5/1976 | Topham |
| 3,977,555 | A | 8/1976 | Larson |
| 3,993,063 | A | 11/1976 | Larrabee |
| 4,020,839 | A | 5/1977 | Klapp |
| 4,026,128 | A | 5/1977 | Blanco |

(56) References Cited

U.S. PATENT DOCUMENTS 4,051,852 A 10/1977 Villari
D247,975 S 5/1978 Luther
D248,568 S 7/1978 Ismach
4,109,670 A 8/1978 Slagel
4,121,585 A 10/1978 Becker, Jr.
4,161,178 A 7/1979 Genese
4,187,848 A 2/1980 Taylor
D254,444 S 3/1980 Levine
4,203,067 A 5/1980 Fitzky et al.
4,203,443 A 5/1980 Genese
4,210,173 A 7/1980 Choksi et al.
D257,286 S 10/1980 Folkman
4,253,501 A 3/1981 Ogle
4,296,786 A 10/1981 Brignola
4,303,067 A 12/1981 Connolly et al.
4,312,349 A 1/1982 Cohen
4,314,586 A 2/1982 Folkman
4,328,802 A 5/1982 Curley et al.
4,335,717 A 6/1982 Bujan et al.
D267,199 S 12/1982 Koenig
4,376,634 A 3/1983 Prior et al.
D268,871 S 5/1983 Benham et al.
4,392,850 A 7/1983 Elias et al.
D270,282 S 8/1983 Gross
4,410,321 A 10/1983 Pearson et al.
4,411,662 A 10/1983 Pearson
D271,421 S 11/1983 Fetterman
4,434,823 A 3/1984 Hudspith
4,465,471 A 8/1984 Harris et al.
4,475,915 A 10/1984 Sloane
4,493,348 A 1/1985 Lemmons
4,505,709 A 3/1985 Froning et al.
4,507,113 A 3/1985 Dunlap
D280,018 S 8/1985 Scott
4,532,969 A 8/1985 Kwaan
4,564,054 A 1/1986 Gustaysson
4,573,993 A 3/1986 Hoag et al.
4,576,211 A 3/1986 Valentini et al.
4,581,014 A 4/1986 Millerd et al.
4,585,446 A 4/1986 Kempf
4,588,396 A 5/1986 Stroebel et al.
4,588,403 A 5/1986 Weiss et al.
D284,603 S 7/1986 Loignon
4,604,093 A 8/1986 Brown et al.
4,607,671 A 8/1986 Aalto et al.
4,614,437 A 9/1986 Buehler
4,638,975 A 1/1987 Iuchi et al.
4,639,019 A 1/1987 Mittleman
4,667,927 A 5/1987 Oscarsson
4,675,020 A 6/1987 McPhee
4,676,530 A 6/1987 Nordgren et al.
4,683,975 A 8/1987 Booth et al.
4,697,622 A 10/1987 Swift et al.
4,721,133 A 1/1988 Sundblom
4,729,401 A 3/1988 Raines
4,735,608 A 4/1988 Sardam
4,743,229 A 5/1988 Chu
4,743,243 A 5/1988 Vaillancourt
4,752,292 A 6/1988 Lopez et al.
4,758,235 A 7/1988 Tu
4,759,756 A 7/1988 Forman et al.
4,778,447 A 10/1988 Velde et al.
4,787,898 A 11/1988 Raines
4,797,898 A 1/1989 Martinez
D300,060 S 2/1989 Molgaard-Nielsen
4,804,366 A 2/1989 Zdeb et al.
4,826,492 A 5/1989 Magasi
4,832,690 A 5/1989 Kuu
4,834,152 A 5/1989 Howson et al.
D303,013 S 8/1989 Konopka
4,857,062 A 8/1989 Russell
4,865,592 A 9/1989 Rycroft
4,871,463 A 10/1989 Taylor et al.
4,898,209 A 2/1990 Zbed
4,909,290 A 3/1990 Coccia
4,919,596 A 4/1990 Slate et al.
4,927,423 A 5/1990 Malmborg
4,931,040 A 6/1990 Haber et al.
4,932,944 A 6/1990 Jagger et al.
4,967,797 A 11/1990 Manska
D314,050 S 1/1991 Sone
D314,622 S 2/1991 Andersson et al.
4,997,430 A 3/1991 Van Der Heiden et al.
5,006,114 A 4/1991 Rogers et al.
5,035,686 A 7/1991 Crittenden et al.
5,041,105 A 8/1991 D'Alo et al.
5,045,066 A 9/1991 Scheuble et al.
5,049,129 A 9/1991 Zdeb et al.
5,053,015 A 10/1991 Gross
5,061,248 A 10/1991 Sacco
5,088,996 A 2/1992 Kopfer et al.
5,096,575 A 3/1992 Cosack
5,104,387 A 4/1992 Pokorney et al.
5,113,904 A 5/1992 Aslanian
5,122,124 A 6/1992 Novacek et al.
5,125,908 A 6/1992 Cohen
5,125,915 A 6/1992 Berry et al.
D328,788 S 8/1992 Sagae et al.
5,171,230 A 12/1992 Eland et al.
5,201,705 A 4/1993 Berglund et al.
5,201,717 A 4/1993 Wyatt et al.
5,203,771 A 4/1993 Melker et al.
5,203,775 A 4/1993 Frank et al.
5,211,638 A 5/1993 Dudar et al.
5,232,029 A 8/1993 Knox et al.
5,232,109 A 8/1993 Tirrell et al.
5,242,432 A 9/1993 DeFrank
5,247,972 A 9/1993 Tetreault
D341,420 S 11/1993 Conn
5,269,768 A 12/1993 Cheung
5,270,219 A 12/1993 DeCastro et al.
5,279,576 A 1/1994 Loo et al.
5,288,290 A 2/1994 Brody
5,300,034 A 4/1994 Behnke et al.
5,301,685 A 4/1994 Guirguis
5,304,163 A 4/1994 Bonnici et al.
5,304,165 A 4/1994 Haber et al.
5,308,483 A 5/1994 Sklar et al.
5,312,377 A 5/1994 Dalton
5,328,474 A 7/1994 Raines
D349,648 S 8/1994 Tirrell et al.
5,334,163 A 8/1994 Sinnett
5,334,179 A 8/1994 Poli et al.
5,342,346 A 8/1994 Honda et al.
5,344,417 A 9/1994 Wadsworth, Jr.
5,348,544 A 9/1994 Sweeney et al.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,482,446 A 1/1996 Williamson et al.
5,492,147 A 2/1996 Challender et al.
5,496,274 A 3/1996 Graves et al.
D369,406 S 4/1996 Niedospial et al.
5,505,714 A 4/1996 Dassa et al.

(56) References Cited

U.S. PATENT DOCUMENTS 5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,562,686 A 10/1996 Sauer et al.
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,658,133 A 8/1997 Anderson et al.
5,672,160 A 9/1997 Osterlind et al.
5,674,195 A 10/1997 Truthan
5,676,346 A 10/1997 Leinsing
5,685,845 A 11/1997 Grimard
D388,172 S 12/1997 Cipes
5,699,821 A 12/1997 Paradis
5,702,019 A 12/1997 Grimard
5,718,346 A 2/1998 Weiler
5,728,087 A 3/1998 Niedospial, Jr.
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
5,814,020 A 9/1998 Gross
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,868,710 A 2/1999 Battiato et al.
5,871,110 A 2/1999 Grimard et al.
5,873,872 A 2/1999 Thibault et al.
5,879,337 A 3/1999 Kuracina et al.
5,879,345 A * 3/1999 Aneas ..... A61J 1/2089
215/277
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,941,850 A 8/1999 Shah et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.
6,080,132 A 6/2000 Cole et al.
D428,141 S 7/2000 Brotspies et al.
6,086,762 A 7/2000 Guala
6,089,541 A 7/2000 Weinheimer et al.
6,090,091 A 7/2000 Fowles et al.
6,090,093 A 7/2000 Thibault et al.
6,092,692 A 7/2000 Riskin
D430,291 S 8/2000 Jansen et al.
6,099,511 A 8/2000 Devos et al.
6,113,068 A 9/2000 Ryan
6,113,583 A 9/2000 Fowles et al.
6,117,114 A 9/2000 Paradis
D431,864 S 10/2000 Jansen
6,139,534 A 10/2000 Niedospial, Jr. et al.
6,142,446 A 11/2000 Leinsing
6,146,362 A 11/2000 Turnbull et al.
6,149,623 A 11/2000 Reynolds
6,156,025 A 12/2000 Niedospial, Jr. et al.
6,159,192 A 12/2000 Fowles et al.
6,168,037 B1 1/2001 Grimard
6,171,287 B1 1/2001 Lynn et al.
6,171,293 B1 1/2001 Rowley et al.
6,173,852 B1 1/2001 Browne
6,173,868 B1 1/2001 DeJonge
6,174,304 B1 1/2001 Weston
6,179,822 B1 1/2001 Niedospial, Jr.
6,179,823 B1 1/2001 Niedospial, Jr.
6,186,997 B1 2/2001 Gabbard et al.
6,206,861 B1 3/2001 Mayer
6,221,041 B1 4/2001 Russo
6,221,054 B1 4/2001 Martin et al.
6,221,065 B1 4/2001 Davis
6,238,372 B1 5/2001 Zinger et al.
6,245,044 B1 6/2001 Daw et al.
D445,501 S 7/2001 Niedospial, Jr.
D445,895 S 7/2001 Svendsen
6,253,804 B1 7/2001 Safabash
6,258,078 B1 7/2001 Thilly
6,280,430 B1 8/2001 Neftel et al.
6,290,688 B1 9/2001 Lopez et al.
6,296,621 B1 10/2001 Masuda et al.
6,299,131 B1 10/2001 Ryan
6,343,629 B1 2/2002 Wessman et al.
6,348,044 B1 2/2002 Coletti et al.
6,358,236 B1 3/2002 DeFoggi et al.
6,364,866 B1 4/2002 Furr et al.
6,378,576 B2 4/2002 Thibault et al.
6,378,714 B1 4/2002 Jansen et al.

(56) References Cited

U.S. PATENT DOCUMENTS

| | | | |
|---|---|---|---|
| 6,379,340 | B1 | 4/2002 | Zinger et al. |
| D457,954 | S | 5/2002 | Wallace et al. |
| 6,382,442 | B1 | 5/2002 | Thibault et al. |
| 6,386,397 | B2 | 5/2002 | Brotspies et al. |
| 6,408,897 | B1 | 6/2002 | Laurent et al. |
| 6,409,708 | B1 | 6/2002 | Wessman |
| 6,440,107 | B1 | 8/2002 | Trombley, III et al. |
| 6,453,949 | B1 | 9/2002 | Chau |
| 6,453,956 | B2 | 9/2002 | Safabash |
| 6,474,375 | B2 | 11/2002 | Spero et al. |
| 6,478,788 | B1 | 11/2002 | Aneas |
| D468,015 | S | 12/2002 | Horppu |
| 6,499,617 | B1 | 12/2002 | Niedospial, Jr. et al. |
| 6,503,240 | B1 | 1/2003 | Niedospial, Jr. et al. |
| 6,503,244 | B2 | 1/2003 | Hayman |
| 6,520,932 | B2 | 2/2003 | Taylor |
| 6,524,278 | B1 | 2/2003 | Campbell et al. |
| 6,524,295 | B2 | 2/2003 | Daubert et al. |
| D472,316 | S | 3/2003 | Douglas et al. |
| 6,530,903 | B2 | 3/2003 | Wang et al. |
| 6,537,263 | B1 | 3/2003 | Aneas |
| D472,630 | S | 4/2003 | Douglas et al. |
| 6,544,246 | B1 | 4/2003 | Niedospial, Jr. |
| 6,551,299 | B2 | 4/2003 | Miyoshi et al. |
| 6,558,365 | B2 | 5/2003 | Zinger et al. |
| 6,571,837 | B2 | 6/2003 | Jansen et al. |
| 6,572,591 | B2 | 6/2003 | Mayer |
| 6,575,955 | B2 | 6/2003 | Azzolini |
| 6,581,593 | B1 | 6/2003 | Rubin et al. |
| 6,582,415 | B1 | 6/2003 | Fowles et al. |
| D476,731 | S | 7/2003 | Cise et al. |
| 6,591,876 | B2 | 7/2003 | Safabash |
| 6,599,273 | B1 | 7/2003 | Lopez |
| 6,601,721 | B2 | 8/2003 | Jansen et al. |
| 6,626,309 | B1 | 9/2003 | Jansen et al. |
| 6,632,201 | B1 | 10/2003 | Mathias et al. |
| 6,638,244 | B1 | 10/2003 | Reynolds |
| D482,121 | S | 11/2003 | Harding et al. |
| D482,447 | S | 11/2003 | Harding et al. |
| 6,651,956 | B2 | 11/2003 | Miller |
| 6,652,509 | B1 | 11/2003 | Helgren et al. |
| D483,487 | S | 12/2003 | Harding et al. |
| D483,869 | S | 12/2003 | Tran et al. |
| 6,656,433 | B2 | 12/2003 | Sasso |
| 6,666,852 | B2 | 12/2003 | Niedospial, Jr. |
| 6,681,810 | B2 | 1/2004 | Weston |
| 6,681,946 | B1 | 1/2004 | Jansen et al. |
| 6,682,509 | B2 | 1/2004 | Lopez |
| 6,692,478 | B1 | 2/2004 | Paradis |
| 6,692,829 | B2 | 2/2004 | Stubler et al. |
| 6,695,829 | B2 | 2/2004 | Hellstrom et al. |
| 6,699,229 | B2 | 3/2004 | Zinger et al. |
| 6,706,022 | B1 | 3/2004 | Leinsing et al. |
| 6,706,031 | B2 | 3/2004 | Manera |
| 6,715,520 | B2 | 4/2004 | Andreasson et al. |
| 6,729,370 | B2 | 5/2004 | Norton et al. |
| 6,736,798 | B2 | 5/2004 | Ohkubo et al. |
| 6,745,998 | B2 | 6/2004 | Doyle |
| 6,746,438 | B1 | 6/2004 | Amissolle |
| 6,752,180 | B2 | 6/2004 | Delay |
| D495,416 | S | 8/2004 | Dimeo et al. |
| D496,457 | S | 9/2004 | Prais et al. |
| 6,802,490 | B2 | 10/2004 | Leinsing et al. |
| 6,832,994 | B2 | 12/2004 | Niedospial, Jr. et al. |
| 6,852,103 | B2 | 2/2005 | Fowles et al. |
| 6,875,203 | B1 | 4/2005 | Fowles et al. |
| 6,875,205 | B2 | 4/2005 | Leinsing |
| 6,878,131 | B2 | 4/2005 | Novacek et al. |
| 6,884,253 | B1 | 4/2005 | McFarlane |
| 6,890,328 | B2 | 5/2005 | Fowles et al. |
| D506,256 | S | 6/2005 | Miyoshi et al. |
| 6,901,975 | B2 | 6/2005 | Aramata et al. |
| 6,945,417 | B2 | 9/2005 | Jansen et al. |
| 6,948,522 | B2 | 9/2005 | Newbrough et al. |
| 6,949,086 | B2 | 9/2005 | Ferguson et al. |
| 6,951,613 | B2 | 10/2005 | Reif et al. |
| 6,957,745 | B2 | 10/2005 | Thibault et al. |
| 6,960,164 | B2 | 11/2005 | O'Heeron |
| 6,972,002 | B2 | 12/2005 | Thorne |
| 6,979,318 | B1 | 12/2005 | McDonald et al. |
| RE38,996 | E | 2/2006 | Crawford et al. |
| 6,994,315 | B2 | 2/2006 | Ryan et al. |
| 6,997,916 | B2 | 2/2006 | Simas, Jr. et al. |
| 6,997,917 | B2 | 2/2006 | Niedospial, Jr. et al. |
| 7,024,968 | B2 | 4/2006 | Raudabough et al. |
| 7,070,589 | B2 | 7/2006 | Lolachi et al. |
| 7,074,216 | B2 | 7/2006 | Fowles et al. |
| 7,083,600 | B2 | 8/2006 | Meloul |
| 7,086,431 | B2 | 8/2006 | D'Antonio et al. |
| 7,097,637 | B2 | 8/2006 | Triplett et al. |
| 7,100,890 | B2 | 9/2006 | Cote, Sr. et al. |
| 7,140,401 | B2 | 11/2006 | Wilcox et al. |
| 7,150,735 | B2 | 12/2006 | Hickle |
| 7,192,423 | B2 | 3/2007 | Wong |
| 7,195,623 | B2 | 3/2007 | Burroughs et al. |
| 7,241,285 | B1 | 7/2007 | Dikeman |
| 7,294,122 | B2 | 11/2007 | Kubo et al. |
| 7,306,199 | B2 | 12/2007 | Leinsing et al. |
| D561,348 | S | 2/2008 | Zinger et al. |
| 7,326,188 | B1 | 2/2008 | Russell et al. |
| 7,326,194 | B2 | 2/2008 | Zinger et al. |
| 7,350,764 | B2 | 4/2008 | Raybuck |
| 7,354,422 | B2 | 4/2008 | Riesenberger et al. |
| 7,354,427 | B2 | 4/2008 | Fangrow |
| 7,425,209 | B2 | 9/2008 | Fowles et al. |
| 7,435,246 | B2 | 10/2008 | Zihlmann |
| D580,558 | S | 11/2008 | Shigesada et al. |
| 7,452,348 | B2 | 11/2008 | Hasegawa |
| 7,470,257 | B2 | 12/2008 | Norton et al. |
| 7,470,265 | B2 | 12/2008 | Brugger et al. |
| 7,472,932 | B2 | 1/2009 | Weber et al. |
| 7,488,297 | B2 | 2/2009 | Flaherty |
| 7,491,197 | B2 | 2/2009 | Jansen et al. |
| 7,497,848 | B2 | 3/2009 | Leinsing et al. |
| 7,523,967 | B2 | 4/2009 | Steppe |
| 7,530,546 | B2 | 5/2009 | Ryan et al. |
| D595,420 | S | 6/2009 | Suzuki et al. |
| D595,421 | S | 6/2009 | Suzuki et al. |
| 7,540,863 | B2 | 6/2009 | Haindl |
| 7,540,865 | B2 | 6/2009 | Griffin et al. |
| 7,544,191 | B2 | 6/2009 | Peluso et al. |
| D595,862 | S | 7/2009 | Suzuki et al. |
| D595,863 | S | 7/2009 | Suzuki et al. |
| 7,611,487 | B2 | 11/2009 | Woehr et al. |
| 7,611,502 | B2 | 11/2009 | Daly |
| 7,615,041 | B2 | 11/2009 | Sullivan et al. |
| 7,628,779 | B2 | 12/2009 | Aneas |
| 7,632,261 | B2 | 12/2009 | Zinger et al. |
| D608,900 | S | 1/2010 | Giraud et al. |
| 7,654,995 | B2 | 2/2010 | Warren et al. |
| 7,670,326 | B2 | 3/2010 | Shemesh |
| 7,695,445 | B2 | 4/2010 | Yuki |
| 7,704,229 | B2 | 4/2010 | Moberg et al. |
| D616,090 | S | 5/2010 | Kawamura |
| 7,713,247 | B2 | 5/2010 | Lopez |
| 7,717,886 | B2 | 5/2010 | Lopez |
| 7,722,090 | B2 | 5/2010 | Burton et al. |
| D616,984 | S | 6/2010 | Gilboa |
| 7,731,678 | B2 | 6/2010 | Tennican et al. |
| 7,743,799 | B2 | 6/2010 | Mosler et al. |
| 7,744,581 | B2 | 6/2010 | Wallen et al. |
| 7,757,901 | B2 | 7/2010 | Welp |
| 7,758,082 | B2 | 7/2010 | Weigel et al. |
| 7,758,560 | B2 | 7/2010 | Connell et al. |
| 7,762,524 | B2 | 7/2010 | Cawthon et al. |
| 7,766,304 | B2 | 8/2010 | Phillips |
| 7,771,383 | B2 | 8/2010 | Truitt et al. |
| D624,641 | S | 9/2010 | Boclet |
| 7,799,009 | B2 | 9/2010 | Niedospial, Jr. et al. |
| 7,803,140 | B2 | 9/2010 | Fangrow, Jr. |
| D627,216 | S | 11/2010 | Fulginiti |
| D630,732 | S | 1/2011 | Lev et al. |
| 7,862,537 | B2 | 1/2011 | Zinger et al. |
| 7,867,215 | B2 | 1/2011 | Akerlund et al. |

(56) References Cited

U.S. PATENT DOCUMENTS

| | | | |
|---|---|---|---|
| 7,879,018 | B2 | 2/2011 | Zinger et al. |
| 7,883,499 | B2 | 2/2011 | Fangrow |
| 7,895,216 | B2 | 2/2011 | Longshaw et al. |
| D634,007 | S | 3/2011 | Zinger et al. |
| 7,900,659 | B2 | 3/2011 | Whitley et al. |
| D637,713 | S | 5/2011 | Nord et al. |
| 7,963,954 | B2 | 6/2011 | Kavazov |
| D641,080 | S | 7/2011 | Zinger et al. |
| 7,985,216 | B2 | 7/2011 | Daily et al. |
| D644,104 | S | 8/2011 | Maeda et al. |
| 7,993,328 | B2 | 8/2011 | Whitley |
| 8,007,461 | B2 | 8/2011 | Huo et al. |
| 8,012,132 | B2 | 9/2011 | Lum et al. |
| 8,016,809 | B2 | 9/2011 | Zinger et al. |
| 8,021,325 | B2 | 9/2011 | Zinger et al. |
| 8,025,653 | B2 | 9/2011 | Capitaine et al. |
| 8,025,683 | B2 | 9/2011 | Morrison |
| 8,029,472 | B2 | 10/2011 | Leinsing et al. |
| 8,038,123 | B2 | 10/2011 | Ruschke et al. |
| 8,066,688 | B2 | 11/2011 | Zinger et al. |
| 8,070,739 | B2 | 12/2011 | Zinger et al. |
| 8,075,550 | B2 | 12/2011 | Nord et al. |
| 8,096,525 | B2 | 1/2012 | Ryan |
| 8,105,314 | B2 | 1/2012 | Fangrow, Jr. |
| D654,166 | S | 2/2012 | Lair |
| D655,017 | S | 2/2012 | Mosler et al. |
| 8,122,923 | B2 | 2/2012 | Kraus et al. |
| 8,123,736 | B2 | 2/2012 | Kraushaar et al. |
| D655,071 | S | 3/2012 | Davila |
| D657,461 | S | 4/2012 | Schembre et al. |
| 8,152,779 | B2 | 4/2012 | Cabiri |
| 8,157,784 | B2 | 4/2012 | Rogers |
| 8,167,863 | B2 | 5/2012 | Yow |
| 8,172,824 | B2 | 5/2012 | Pfeifer et al. |
| 8,177,768 | B2 | 5/2012 | Leinsing |
| 8,182,452 | B2 | 5/2012 | Mansour et al. |
| 8,187,248 | B2 | 5/2012 | Zihlmann |
| 8,196,614 | B2 | 6/2012 | Kriheli |
| 8,197,459 | B2 | 6/2012 | Jansen et al. |
| 8,211,069 | B2 | 7/2012 | Fangrow, Jr. |
| 8,225,959 | B2 | 7/2012 | Lambrecht |
| 8,241,268 | B2 | 8/2012 | Whitley |
| 8,262,628 | B2 | 9/2012 | Fangrow, Jr. |
| 8,262,641 | B2 | 9/2012 | Vedrine et al. |
| 8,267,127 | B2 | 9/2012 | Kriheli |
| D669,980 | S | 10/2012 | Lev et al. |
| 8,287,513 | B2 | 10/2012 | Ellstrom et al. |
| 8,328,784 | B2 | 12/2012 | Jensen et al. |
| D673,673 | S | 1/2013 | Wang |
| D674,084 | S | 1/2013 | Linnenschmidt |
| D674,088 | S | 1/2013 | Lev et al. |
| 8,348,898 | B2 | 1/2013 | Cabiri |
| D681,230 | S | 4/2013 | Mosler et al. |
| 8,454,573 | B2 | 6/2013 | Wyatt et al. |
| 8,469,939 | B2 | 6/2013 | Fangrow, Jr. |
| 8,475,404 | B2 | 7/2013 | Foshee et al. |
| 8,480,645 | B1 | 7/2013 | Choudhury et al. |
| 8,480,646 | B2 | 7/2013 | Nord et al. |
| 8,506,548 | B2 | 8/2013 | Okiyama |
| 8,511,352 | B2 | 8/2013 | Kraus et al. |
| 8,512,309 | B2 | 8/2013 | Shemesh et al. |
| D690,009 | S | 9/2013 | Schembre et al. |
| D690,418 | S | 9/2013 | Rosenquist |
| 8,523,837 | B2 | 9/2013 | Wiggins et al. |
| 8,545,476 | B2 | 10/2013 | Ariagno et al. |
| 8,551,067 | B2 | 10/2013 | Zinger et al. |
| 8,556,879 | B2 | 10/2013 | Okiyama |
| 8,562,582 | B2 | 10/2013 | Tuckwell et al. |
| 8,608,723 | B2 | 12/2013 | Lev et al. |
| 8,628,508 | B2 | 1/2014 | Weitzel et al. |
| 8,636,689 | B2 | 1/2014 | Halili, Jr. et al. |
| 8,684,992 | B2 | 4/2014 | Sullivan et al. |
| 8,684,994 | B2 | 4/2014 | Lev et al. |
| 8,752,598 | B2 | 6/2014 | Denenburg et al. |
| D714,935 | S | 10/2014 | Nishioka et al. |
| D717,406 | S | 11/2014 | Stanley et al. |
| D717,948 | S | 11/2014 | Strong et al. |
| D719,650 | S | 12/2014 | Arinobe et al. |
| D720,067 | S | 12/2014 | Rosenquist |
| D720,451 | S | 12/2014 | Denenburg et al. |
| D720,452 | S | 12/2014 | Jordan |
| 8,900,212 | B2 | 12/2014 | Kubo |
| 8,905,994 | B1 | 12/2014 | Lev et al. |
| 8,915,882 | B2 | 12/2014 | Cabiri |
| D720,850 | S | 1/2015 | Hsia et al. |
| D732,660 | S | 6/2015 | Ohashi |
| D732,664 | S | 6/2015 | Woehr et al. |
| D733,291 | S | 6/2015 | Wang |
| D733,292 | S | 6/2015 | Rogers |
| D733,293 | S | 6/2015 | Rogers |
| 9,072,827 | B2 | 7/2015 | Cabiri |
| D738,494 | S | 9/2015 | Kashmirian |
| D741,457 | S | 10/2015 | Guest |
| 9,149,575 | B2 | 10/2015 | Cabiri |
| D750,235 | S | 2/2016 | Maurice |
| 9,254,242 | B2 | 2/2016 | Mueller et al. |
| D757,933 | S | 5/2016 | Lev et al. |
| 9,339,438 | B2 | 5/2016 | Lev et al. |
| 9,393,365 | B2 | 7/2016 | Cabiri |
| 9,414,991 | B2 | 8/2016 | Sanders et al. |
| 9,486,391 | B2 | 11/2016 | Shemesh |
| 9,492,610 | B2 | 11/2016 | Cabiri |
| 9,511,190 | B2 | 12/2016 | Cabiri |
| 9,522,234 | B2 | 12/2016 | Cabiri |
| D794,183 | S | 8/2017 | Lev et al. |
| 9,763,855 | B2 | 9/2017 | Fangrow |
| 9,801,786 | B2 | 10/2017 | Lev et al. |
| 10,206,854 | B2 | 2/2019 | Wu et al. |
| 10,376,654 | B2 | 8/2019 | Sanders et al. |
| 2001/0000347 | A1 | 4/2001 | Hellstrom et al. |
| 2001/0025671 | A1 | 10/2001 | Safabash |
| 2001/0029360 | A1 | 10/2001 | Miyoshi et al. |
| 2001/0051793 | A1 | 12/2001 | Weston |
| 2002/0017328 | A1 | 2/2002 | Loo |
| 2002/0055711 | A1 | 5/2002 | Lavi et al. |
| 2002/0065488 | A1 | 5/2002 | Suzuki et al. |
| 2002/0066715 | A1 | 6/2002 | Niedospial |
| 2002/0087118 | A1 | 7/2002 | Reynolds et al. |
| 2002/0087141 | A1 | 7/2002 | Zinger et al. |
| 2002/0087144 | A1 | 7/2002 | Zinger et al. |
| 2002/0104584 | A1 | 8/2002 | Spero et al. |
| 2002/0115980 | A1 | 8/2002 | Niedospial et al. |
| 2002/0121496 | A1 | 9/2002 | Thiebault et al. |
| 2002/0123736 | A1 | 9/2002 | Fowles et al. |
| 2002/0127150 | A1 | 9/2002 | Sasso |
| 2002/0128628 | A1 | 9/2002 | Fathallah |
| 2002/0138045 | A1 | 9/2002 | Moen |
| 2002/0173752 | A1 | 11/2002 | Polzin |
| 2002/0193777 | A1 | 12/2002 | Aneas |
| 2003/0028156 | A1 | 2/2003 | Juliar |
| 2003/0036725 | A1 | 2/2003 | Lavi et al. |
| 2003/0068354 | A1 | 4/2003 | Reif et al. |
| 2003/0069550 | A1 | 4/2003 | Sharp |
| 2003/0073971 | A1 | 4/2003 | Saker |
| 2003/0100866 | A1 | 5/2003 | Reynolds |
| 2003/0109846 | A1 | 6/2003 | Zinger et al. |
| 2003/0120209 | A1 | 6/2003 | Jensen et al. |
| 2003/0135159 | A1 | 7/2003 | Daily et al. |
| 2003/0153895 | A1 | 8/2003 | Leinsing |
| 2003/0187420 | A1 | 10/2003 | Akerlund et al. |
| 2003/0191445 | A1 | 10/2003 | Wallen et al. |
| 2003/0195479 | A1 | 10/2003 | Kuracina et al. |
| 2003/0199827 | A1 | 10/2003 | Thorne |
| 2003/0199846 | A1 | 10/2003 | Fowles et al. |
| 2003/0199847 | A1 | 10/2003 | Akerlund et al. |
| 2003/0205843 | A1 | 11/2003 | Adams |
| 2003/0236543 | A1 | 12/2003 | Brenneman et al. |
| 2004/0010207 | A1 | 1/2004 | Flaherty et al. |
| 2004/0024354 | A1 | 2/2004 | Reynolds |
| 2004/0039365 | A1 | 2/2004 | Aramata et al. |
| 2004/0044327 | A1 | 3/2004 | Hasegawa |
| 2004/0073189 | A1 | 4/2004 | Wyatt et al. |
| 2004/0143218 | A1 | 7/2004 | Das |
| 2004/0143226 | A1 | 7/2004 | Marsden |

(56) References Cited

U.S. PATENT DOCUMENTS

2004/0153047 A1 8/2004 Blank et al.
2004/0158172 A1 8/2004 Hancock
2004/0162540 A1 8/2004 Walenciak et al.
2004/0167472 A1 8/2004 Howell et al.
2004/0181192 A1 9/2004 Cuppy
2004/0186424 A1 9/2004 Hjertman
2004/0199139 A1 10/2004 Fowles et al.
2004/0204699 A1 10/2004 Hanly et al.
2004/0217315 A1 11/2004 Doyle
2004/0225274 A1 11/2004 Jansen et al.
2004/0236305 A1 11/2004 Jansen et al.
2004/0249341 A1 12/2004 Newbrough et al.
2004/0255952 A1 12/2004 Carlsen et al.
2005/0015070 A1 1/2005 Delnevo et al.
2005/0016626 A1 1/2005 Wilcox et al.
2005/0049553 A1 3/2005 Triplett et al.
2005/0055008 A1 3/2005 Paradis et al.
2005/0082828 A1 4/2005 Wicks et al.
2005/0124964 A1 6/2005 Niedospial et al.
2005/0137523 A1 6/2005 Wyatt et al.
2005/0137566 A1 6/2005 Fowles et al.
2005/0148994 A1 7/2005 Leinsing
2005/0159706 A1 7/2005 Wilkinson et al.
2005/0159724 A1 7/2005 Enerson
2005/0182383 A1 8/2005 Wallen
2005/0209554 A1 9/2005 Landau
2005/0261637 A1 11/2005 Miller
2005/0277896 A1 12/2005 Messerli et al.
2006/0030832 A1 2/2006 Niedospial et al.
2006/0079834 A1 4/2006 Tennican et al.
2006/0089594 A1 4/2006 Landau
2006/0089603 A1 4/2006 Truitt et al.
2006/0095015 A1 5/2006 Hobbs et al.
2006/0106360 A1 5/2006 Wong
2006/0135948 A1 6/2006 Varma
2006/0155257 A1 7/2006 Reynolds
2006/0161192 A1 7/2006 Young
2006/0173410 A1 8/2006 Moberg et al.
2006/0178646 A1 8/2006 Harris et al.
2006/0195029 A1 8/2006 Shults et al.
2006/0212004 A1 9/2006 Atil
2006/0253084 A1 11/2006 Nordgren
2006/0259004 A1 11/2006 Connell et al.
2007/0016381 A1 1/2007 Kamath et al.
2007/0024995 A1 2/2007 Hayashi
2007/0060904 A1 3/2007 Vedrine et al.
2007/0078428 A1 4/2007 Reynolds et al.
2007/0079894 A1 4/2007 Kraus et al.
2007/0083164 A1 4/2007 Barrelle et al.
2007/0088252 A1 4/2007 Pestotnik et al.
2007/0088293 A1 4/2007 Fangrow
2007/0088313 A1 4/2007 Zinger et al.
2007/0106218 A1 5/2007 Yodfat et al.
2007/0106244 A1 5/2007 Mosler et al.
2007/0112324 A1 5/2007 Hamedi-Sangsari
2007/0156112 A1 7/2007 Walsh
2007/0167904 A1 7/2007 Zinger et al.
2007/0167912 A1 7/2007 Causey et al.
2007/0191760 A1 8/2007 Iguchi et al.
2007/0191764 A1 8/2007 Zihlmann
2007/0191767 A1 8/2007 Hennessy et al.
2007/0203451 A1 8/2007 Murakami et al.
2007/0219483 A1 9/2007 Kitani et al.
2007/0244447 A1 10/2007 Capitaine et al.
2007/0244461 A1 10/2007 Fangrow
2007/0244462 A1 10/2007 Fangrow
2007/0244463 A1 10/2007 Warren et al.
2007/0249995 A1 10/2007 Van Manen
2007/0255202 A1 11/2007 Kitani et al.
2007/0265574 A1 11/2007 Tennican et al.
2007/0265581 A1 11/2007 Funamura et al.
2007/0270778 A9 11/2007 Zinger et al.
2007/0287953 A1 12/2007 Ziv et al.
2007/0299404 A1 12/2007 Katoh et al.
2008/0009789 A1 1/2008 Zinger et al.
2008/0009822 A1 1/2008 Enerson
2008/0015496 A1 1/2008 Hamedi-Sangsari
2008/0132851 A1 6/2008 Shaw et al.
2008/0135051 A1 6/2008 Lee
2008/0172024 A1 7/2008 Yow
2008/0188799 A1 8/2008 Mueller-Beckhaus et al.
2008/0195049 A1 8/2008 Thalmann et al.
2008/0208138 A1 8/2008 Lim et al.
2008/0215015 A1 9/2008 Cindrich et al.
2008/0249473 A1 10/2008 Ruth et al.
2008/0249479 A1 10/2008 Zinger et al.
2008/0249498 A1 10/2008 Fangrow
2008/0262465 A1 10/2008 Zinger et al.
2008/0269687 A1 10/2008 Chong et al.
2008/0275407 A1 11/2008 Scheurer
2008/0287905 A1 11/2008 Hiejima et al.
2008/0294100 A1 11/2008 de Costa et al.
2008/0306439 A1 12/2008 Nelson et al.
2008/0312634 A1 12/2008 Helmerson et al.
2009/0012492 A1 1/2009 Zihlmann
2009/0043253 A1 2/2009 Podaima
2009/0054834 A1 2/2009 Zinger et al.
2009/0054852 A1 2/2009 Takano et al.
2009/0062767 A1 3/2009 Van Antwerp et al.
2009/0076360 A1 3/2009 Brister et al.
2009/0082750 A1 3/2009 Denenburg et al.
2009/0139724 A1 6/2009 Gray et al.
2009/0143758 A1 6/2009 Okiyama
2009/0177177 A1 7/2009 Zinger et al.
2009/0177178 A1 7/2009 Pedersen
2009/0187140 A1 7/2009 Racz
2009/0216103 A1 8/2009 Brister et al.
2009/0216212 A1 8/2009 Fangrow, Jr.
2009/0267011 A1 10/2009 Hatton et al.
2009/0299325 A1 12/2009 Vedrine et al.
2009/0318946 A1 12/2009 Tamesada
2009/0326506 A1 12/2009 Hasegawa et al.
2010/0010443 A1 1/2010 Morgan et al.
2010/0016811 A1 1/2010 Smith
2010/0022985 A1 1/2010 Sullivan et al.
2010/0030181 A1 2/2010 Helle et al.
2010/0036319 A1 2/2010 Drake et al.
2010/0076397 A1 3/2010 Reed et al.
2010/0087786 A1 4/2010 Zinger et al.
2010/0137827 A1 6/2010 Warren et al.
2010/0137831 A1 6/2010 Tsals
2010/0152658 A1 6/2010 Hanson et al.
2010/0160889 A1 6/2010 Smith et al.
2010/0162548 A1 7/2010 Leidig
2010/0168664 A1 7/2010 Zinger et al.
2010/0168712 A1 7/2010 Tuckwell et al.
2010/0179506 A1 7/2010 Shemesh et al.
2010/0198148 A1 8/2010 Zinger et al.
2010/0204670 A1 8/2010 Kraushaar et al.
2010/0228220 A1 9/2010 Zinger et al.
2010/0241088 A1 9/2010 Ranalletta et al.
2010/0274184 A1 10/2010 Chun
2010/0274202 A1 10/2010 Hyde et al.
2010/0286661 A1 11/2010 Raday et al.
2010/0312220 A1 12/2010 Kalitzki
2011/0004143 A1 1/2011 Beiriger et al.
2011/0004184 A1 1/2011 Proksch et al.
2011/0044850 A1 2/2011 Solomon et al.
2011/0054440 A1 3/2011 Lewis
2011/0087164 A1 4/2011 Mosler et al.
2011/0125056 A1 5/2011 Merchant
2011/0144584 A1 6/2011 Wozencroft
2011/0160655 A1 6/2011 Hanson et al.
2011/0160701 A1 6/2011 Wyatt et al.
2011/0172636 A1 7/2011 Aasmul
2011/0175347 A1 7/2011 Okiyama
2011/0218511 A1 9/2011 Yokoyama
2011/0224640 A1 9/2011 Kuhn et al.
2011/0230856 A1 9/2011 Kyle et al.
2011/0264037 A1 10/2011 Foshee et al.
2011/0264069 A1 10/2011 Bochenko
2011/0276007 A1 11/2011 Denenburg
2011/0319827 A1 12/2011 Leinsing et al.
2012/0022344 A1 1/2012 Kube

(56) References Cited

U.S. PATENT DOCUMENTS

| | | | | |
|---|---|---|---|---|
| 2012/0022469 | A1 | 1/2012 | Alpert | |
| 2012/0053555 | A1 | 3/2012 | Ariagno et al. | |
| 2012/0059332 | A1 | 3/2012 | Woehr et al. | |
| 2012/0059346 | A1 | 3/2012 | Sheppard et al. | |
| 2012/0067429 | A1 | 3/2012 | Mosler et al. | |
| 2012/0071819 | A1 | 3/2012 | Bruggemann et al. | |
| 2012/0078214 | A1 | 3/2012 | Finke et al. | |
| 2012/0123382 | A1 | 5/2012 | Kubo | |
| 2012/0184938 | A1 | 7/2012 | Lev et al. | |
| 2012/0215182 | A1 | 8/2012 | Mansour et al. | |
| 2012/0220977 | A1 | 8/2012 | Yow | |
| 2012/0220978 | A1 | 8/2012 | Lev et al. | |
| 2012/0265163 | A1 | 10/2012 | Cheng et al. | |
| 2012/0271229 | A1 | 10/2012 | Lev et al. | |
| 2012/0296307 | A1 | 11/2012 | Holt et al. | |
| 2012/0310203 | A1 | 12/2012 | Khaled et al. | |
| 2012/0323172 | A1 | 12/2012 | Lev et al. | |
| 2012/0323187 | A1 | 12/2012 | Iwase et al. | |
| 2012/0323210 | A1 | 12/2012 | Lev et al. | |
| 2013/0046269 | A1 | 2/2013 | Lev et al. | |
| 2013/0053814 | A1 | 2/2013 | Mueller-Beckhaus et al. | |
| 2013/0096493 | A1 | 4/2013 | Kubo et al. | |
| 2013/0110049 | A1 | 5/2013 | Cronenberg et al. | |
| 2013/0144248 | A1 | 6/2013 | Putter et al. | |
| 2013/0199669 | A1 | 8/2013 | Moy et al. | |
| 2013/0226100 | A1 | 8/2013 | Lev | |
| 2013/0231630 | A1 | 9/2013 | Kraus et al. | |
| 2013/0237904 | A1 | 9/2013 | Deneburg et al. | |
| 2013/0253448 | A1 | 9/2013 | Baron et al. | |
| 2013/0289530 | A1 | 10/2013 | Wyatt et al. | |
| 2014/0020793 | A1 | 1/2014 | Denenburg et al. | |
| 2014/0096862 | A1 | 4/2014 | Aneas | |
| 2014/0150911 | A1 | 6/2014 | Hanner et al. | |
| 2014/0194854 | A1 | 7/2014 | Tsals | |
| 2014/0221940 | A1 | 8/2014 | Clauson et al. | |
| 2014/0277052 | A1 | 9/2014 | Haselby et al. | |
| 2014/0352845 | A1 | 12/2014 | Lev et al. | |
| 2015/0082746 | A1 | 3/2015 | Ivosevic et al. | |
| 2015/0088078 | A1 | 3/2015 | Lev et al. | |
| 2015/0112297 | A1* | 4/2015 | Lev | A61J 1/2089 604/414 |
| 2015/0209230 | A1* | 7/2015 | Lev | A61J 1/2055 604/414 |
| 2015/0290390 | A1 | 10/2015 | Ring et al. | |
| 2015/0297839 | A1 | 10/2015 | Sanders et al. | |
| 2015/0305770 | A1 | 10/2015 | Fill et al. | |
| 2016/0088995 | A1 | 3/2016 | Ueda et al. | |
| 2016/0166824 | A1 | 6/2016 | Lev et al. | |
| 2016/0199569 | A1 | 7/2016 | Yevmenenko et al. | |
| 2016/0228644 | A1 | 8/2016 | Cabiri | |
| 2016/0287475 | A1 | 10/2016 | Yevmenenko et al. | |
| 2016/0367439 | A1 | 12/2016 | Davis et al. | |
| 2019/0133885 | A1 | 5/2019 | Wu et al. | |

FOREIGN PATENT DOCUMENTS

| | | | |
|---|---|---|---|
| CN | 1747683 | A | 3/2006 |
| CN | 1863566 | A | 11/2006 |
| CN | 1950049 | A | 4/2007 |
| CN | 101001661 | A | 7/2007 |
| CN | 101687083 | A | 3/2010 |
| DE | 1064693 | B | 9/1959 |
| DE | 1913926 | A1 | 9/1970 |
| DE | 4122476 | A1 | 1/1993 |
| DE | 4408498 | A1 | 5/1995 |
| DE | 19504413 | A1 | 8/1996 |
| DE | 202004012714 | U1 | 11/2004 |
| DE | 102007046951 | B3 | 2/2009 |
| DE | 202009011019 | U1 | 12/2010 |
| EM | 000627237-0001 | | 1/2007 |
| EM | 001680703-0002 | | 3/2010 |
| EP | 0192661 | A1 | 9/1986 |
| EP | 0195018 | A1 | 9/1986 |
| EP | 0258913 | A2 | 3/1988 |
| EP | 0416454 | A2 | 3/1991 |
| EP | 0426403 | A1 | 5/1991 |
| EP | 0282545 | B1 | 2/1992 |
| EP | 0518397 | A1 | 12/1992 |
| EP | 0521460 | A1 | 1/1993 |
| EP | 582038 | A2 | 2/1994 |
| EP | 0598918 | A1 | 6/1994 |
| EP | 0637443 | A1 | 2/1995 |
| EP | 0737467 | A1 | 10/1996 |
| EP | 761562 | A1 | 3/1997 |
| EP | 765652 | A1 | 4/1997 |
| EP | 765853 | A1 | 4/1997 |
| EP | 0806597 | A1 | 11/1997 |
| EP | 0814866 | A1 | 1/1998 |
| EP | 829248 | A2 | 3/1998 |
| EP | 0856331 | A2 | 8/1998 |
| EP | 882441 | A2 | 12/1998 |
| EP | 0887085 | A2 | 12/1998 |
| EP | 0887885 | A2 | 12/1998 |
| EP | 897708 | A2 | 2/1999 |
| EP | 0898951 | A2 | 3/1999 |
| EP | 960616 | A2 | 12/1999 |
| EP | 1008337 | A1 | 6/2000 |
| EP | 1029526 | A1 | 8/2000 |
| EP | 1034809 | A1 | 9/2000 |
| EP | 1051988 | A2 | 11/2000 |
| EP | 1323403 | A1 | 7/2003 |
| EP | 1329210 | A1 | 7/2003 |
| EP | 1396250 | A1 | 3/2004 |
| EP | 1454609 | A1 | 9/2004 |
| EP | 1454650 | A1 | 9/2004 |
| EP | 1498097 | A2 | 1/2005 |
| EP | 1872824 | A1 | 1/2008 |
| EP | 1911432 | A1 | 4/2008 |
| EP | 1919432 | A1 | 5/2008 |
| EP | 1930038 | A2 | 6/2008 |
| EP | 2090278 | A1 | 8/2009 |
| EP | 2351548 | A1 | 8/2011 |
| EP | 2351549 | A1 | 8/2011 |
| EP | 2462913 | A1 | 6/2012 |
| EP | 2512399 | A1 | 10/2012 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| IL | 186290 | | 1/2008 |
| JP | 03-062426 | B | 9/1991 |
| JP | 4329954 | A | 11/1992 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | A | 5/1998 |
| JP | H10-504736 | A | 5/1998 |
| JP | 11503627 | T | 3/1999 |
| JP | 11-319031 | A | 11/1999 |
| JP | 2000-508934 | A | 7/2000 |
| JP | 2000-237278 | A | 9/2000 |
| JP | 2000262497 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-501721 | A | 1/2004 |
| JP | 2004-097253 | A | 4/2004 |
| JP | 2004-522541 | A | 7/2004 |
| JP | 2005-270629 | A | 10/2005 |
| JP | 200661421 | A | 3/2006 |
| JP | 2008-220961 | A | 9/2008 |
| JP | 2010063622 | A | 3/2010 |
| JP | 2010-179128 | A | 8/2010 |
| JP | 2012-205769 | A | 10/2012 |
| JP | 2014000220 | A | 1/2014 |
| WO | 8601712 | A1 | 3/1986 |
| WO | 8605683 | A1 | 10/1986 |

(56) References Cited

FOREIGN PATENT DOCUMENTS

| | | | |
|---|---|---|---|
| WO | 9003536 | A1 | 4/1990 |
| WO | 9403373 | A1 | 2/1994 |
| WO | 9507066 | A1 | 3/1995 |
| WO | 9513785 | A1 | 5/1995 |
| WO | 9600053 | A1 | 1/1996 |
| WO | 9609083 | A1 | 3/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 0132524 | A1 | 5/2001 |
| WO | 0160311 | A1 | 8/2001 |
| WO | 0189607 | A2 | 11/2001 |
| WO | 0191693 | A2 | 12/2001 |
| WO | 0202165 | A2 | 1/2002 |
| WO | 200209797 | A1 | 2/2002 |
| WO | 0232372 | A1 | 4/2002 |
| WO | 0236191 | A2 | 5/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2004096113 | A2 | 11/2004 |
| WO | 2005002492 | A1 | 1/2005 |
| WO | 2005018703 | A2 | 3/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007/105221 | A1 | 9/2007 |
| WO | 2007101772 | A1 | 9/2007 |
| WO | 2008076459 | A1 | 6/2008 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010078227 | A1 | 7/2010 |
| WO | 2010117580 | A1 | 10/2010 |
| WO | 2011/004360 | A1 | 1/2011 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011090955 | A1 | 7/2011 |
| WO | 2011104711 | A1 | 9/2011 |
| WO | 2011156373 | A1 | 12/2011 |
| WO | 2012/004790 | A2 | 1/2012 |
| WO | 2012004784 | A1 | 1/2012 |
| WO | 2012063230 | A1 | 5/2012 |
| WO | 2012143921 | A1 | 10/2012 |
| WO | 2012150587 | A1 | 11/2012 |
| WO | 2013127813 | A1 | 9/2013 |
| WO | 2013134246 | A1 | 9/2013 |
| WO | 2013148435 | A1 | 10/2013 |
| WO | 2013156944 | A1 | 10/2013 |
| WO | 2013156994 | A1 | 10/2013 |
| WO | 2014033706 | A2 | 3/2014 |
| WO | 2014033710 | A1 | 3/2014 |
| WO | 2014099395 | A1 | 6/2014 |
| WO | 2014170888 | A1 | 10/2014 |
| WO | 2014174278 | A1 | 10/2014 |
| WO | 2016023590 | A1 | 2/2016 |

OTHER PUBLICATIONS

Grifols Vial Adapter Product Literature, 2 pages, Jan. 2002.

Novel Transfer, Mixing and Drug Delivery Systems, MOP Medimop Medical Projects Ltd. Catalog, 4 pages, Rev. 4, 2004.

Smart Site.RTM. Alaris Medical Systems Product Brochure, 4 pages, Issue 1, Oct. 1999.

MixJect, downloaded from webpage: http://www.westpharma.com/en/products/Pages/Mixject.aspx, Download Date: Aug. 8, 2012, 1 page.

MixJet Product Information Sheet, downloaded from webpage: http://www.westpharma.com/SiteCollectionDocuments/Recon/mixject%20product%20sheet.pdf; 1 page.

The MixJect transfer system, as shown in the article, "Advanced Delivery Devices," Drug Delivery Technology Jul./Aug. 2007 vol. 7 No. 7 [on-line]. [Retrieved from Internet May 14, 2020.] URL: <http://www.drugdeiverytech-online.com/drugdelivery/200707/?pg=28pg28>. (3 pages).

Silicone Rubber Overview Downloaded from webpage: http://www.knovel.com/web/portal/browse/display?_EXT_KNOVEL_DISPLAY_bookid=1023&VerticalID=0 on Feb. 9, 2011, Download Date: Sep. 2, 2011, Original Posting Date: 2010, 6 pages.

Kipp, "Plastic Material Data Sheets," retrieved from the internet: http://www.knovel.com/web/portal/browse/display? _EXT_KNOVEL_DISPLAY_bookid=1023&VerticalID=0, retrieved on Feb. 9, 2011.

Alaris Medical Systems Product Brochure, 4 pages, Issue 1, Oct. 11, 1999.

Smart Site Needle-Free Systems, Alaris Medical Systems Webpage, 4 pages, Feb. 2006.

Photographs of Alaris Medical Systems SmartSite.RTM. device, 5 pages, 2002.

Non-Vented Vial Access Pin with Ultrasite.RTM. Valve, B. Braun Medical, Inc. website and product description, 3 pages, Feb. 2006.

IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).

Drug Administration Systems product information sheets; http://www.westpharma.com/eu/en/products/Pages/Vial2Bag.aspx; pp. 1-3 (admitted prior art).

West, Vial2Bag DC system, Oct. 2, 2014, https://web.archive.org/web/20141002065133/http://www.westpharma.com/en/products/Pages/Reconstitutionsystems.aspx.

Vial2Bag DC, downloaded from webpage: https://www.youtube.com/watch?v=FEOkgIxNBrs, Original posting date: Aug. 21, 2014, 1 page.

Vial-Mate Adapter Device, Baxter, May 2017, downloaded from web page:http://www.baxtermedicationdeliveryproducts.com/drug-delivery/vialmate.html, Download Date: Jul. 28, 2017, original posting date: unknown, 1page.

Int'l Preliminary Report on Patentability dated Nov. 26, 2018 in Int'l Application No. PCT/IL2017/051299.

Summit International Medical Technologies Inc., Vial Direct to Bag Spike 2020.

Merchant "An engineered control device for needle free reconstitution and transfer of compounded sterile intravenous drug solutions for immediate use to assist in complying with United States Pharmacopeia Chapter <797> standard", Adv Care, 2 pages, 2018.

* cited by examiner

LIQUID DRUG TRANSFER DEVICES FOR USE WITH INTACT DISCRETE INJECTION VIAL RELEASE TOOL

CROSS-REFERENCE TO RELATED APPLICATION

This application is a Section 371 of International Application No. PCT/IL/2017/051299, filed Nov. 29, 2017, which was published in the English language on Jun. 14, 2018 under International Publication No. WO 2018/104930 A1, and claims priority to Israeli Application No. 249408, filed Dec. 6, 2016, the disclosures of which are incorporated herein by reference in their entirety.

FIELD OF THE INVENTION

The invention relates to liquid drug transfer devices for use with a discrete injection vial.

BACKGROUND OF THE INVENTION

Liquid drug transfer devices having an integral vial adapter for use with a discrete injection vial containing a medicament are available for home use, outpatient clinic use, hospital use, and the like. Exemplary liquid drug transfer devices having an integral vial adapter include inter alia a female vial adapter having a female Luer connector for use with a needleless syringe, a male vial adapter having a male Luer connector, a liquid drug transfer device having an integral administration device and a syringe port for attaching a needleless syringe thereto, a liquid drug transfer device for mixing contents of two injection vials to form a liquid drug for aspiration through a syringe port to a needleless syringe, and the like.

Discrete injection vials include a closed end vial tube typically containing an expensive medicament, a tubular vial crown having a crown opening and a vial neck intermediate the vial tube and the vial crown. Discrete injection vials include an injection vial stopper for hermetically sealing a crown opening and a band for capping the vial crown. Discrete injection vials typically include a flip-off tamper evidence cap intended to be irreplaceably removed immediately before use to expose an uppermost injection vial surface which is sterilized before accessing an injection vial.

Vial adapters have a generally inverted cup shape including an uppermost transverse vial adapter wall and a downward depending vial crown sleeve for bounding a vial crown cavity for receiving a vial crown on telescopic mounting a vial adapter on a discrete injection vial. The uppermost transverse vial adapter wall has a downward depending puncturing cannula with a proximal puncturing cannula opening and a distal puncturing cannula tip for concurrently puncturing an injection vial stopper on telescopic mounting a vial adapter on a discrete injection vial. A vial crown sleeve can optionally have one or more radial inward vial crown holding protrusions for snap fitting under a vial crown on telescopic snap fitting a vial adapter on a discrete injection vial for a more secure mounting.

Telescopic mounting a vial adapter on a discrete injection vial typically takes place adjacent a patient ready for immediate administration of its medicament. Telescopic mounting is considered a relatively problematic task for several reasons: First, healthcare providers having gloved hands have to be dexterous to handle a vial adapter and a discrete injection vial. Second, healthcare providers have to apply a relatively considerable force for concurrently telescopic mounting a vial adapter on a discrete injection vial and puncturing its injection vial stopper. Third, healthcare providers are prone to incorrectly aligning a vial adapter relative to a discrete injection vial such that its distal puncturing cannula tip doesn't puncture an injection vial stopper but rather is embedded therein. And fourth, in case of some medicaments, speed of administration is of utmost importance, and concurrent telescopic mounting a vial adapter on a discrete injection vial and puncturing its injection vial stopper can take a relatively long time.

There is a need to facilitate the use of liquid drug transfer devices having an integral vial adapter with a discrete injection vial.

SUMMARY OF THE INVENTION

The present invention is directed towards liquid drug transfer devices with an integral telescopic vial adapter for use with an initially non-punctured intact discrete injection vial. In its pre-compacted state, the vial adapter telescopically snap fits onto an initially non-punctured intact discrete injection vial without puncturing its injection vial stopper. In its compacted state, the vial adapter punctures the injection vial stopper. The division of the hitherto single step of concurrent telescopic mounting and injection vial stopper puncturing into an initial step of telescopically snap fitting an integral telescopic vial adapter on a discrete injection vial and a subsequent step of compacting an integral telescopic vial adapter for puncturing its injection vial stopper enables the two steps to be performed either by the same healthcare provider or optionally two healthcare providers. In the latter case, a first healthcare provider can be located in a pharmacy, a sterile room, and the like, not adjacent patients and only the second healthcare provider is adjacent patients for administration purposes.

The sole or first healthcare provider has responsibility for telescopically snap fitting a liquid drug transfer device's integral telescopic vial adapter on a discrete injection vial to prepare a so-called Ready-To-Use (RTU) liquid drug transfer assemblage with a pre-attached non-punctured intact discrete injection vial. Puncturing an injection vial stopper requires a considerably greater force than telescopically snap fitting a vial adapter on a discrete injection vial such that a healthcare provider can be cognizant during compacting an integral telescopic vial adapter of the present invention to avoid inadvertently immediately proceeding to puncture an injection vial stopper after snap fitting on an intact discrete injection vial. The integral telescopic vial adapter can be optionally provided with a safety catch mechanism requiring a release action for priming same for enabling compaction. The release action can involve a relative rotation action, a relative linear displacement action, removal of a safety catch, and the like. The sole or first healthcare provider can be availed with apparatus, for example, jigs, and the like, for assisting preparing RTU liquid drug transfer assemblages. In the case of two healthcare providers, the second healthcare provider has the simpler task of compacting an integral telescopic vial adapter of a RTU liquid drug transfer assemblage for puncturing the injection vial stopper of the pre-attached non-punctured intact discrete injection vial adjacent a patient for administration purposes.

Dividing the hitherto concurrent telescopic mounting and injection vial stopper puncturing into two discrete steps can lead to preparation of a RTU liquid drug transfer assemblage for a particular patient which may no longer be required, for example, due to a change in the patient's state of health. The present invention envisages transferring the non-punctured intact discrete injection vial to a new liquid drug transfer device for preparing a new RTU liquid drug transfer assemblage for another patient. In other words, notwithstanding its tamper evidence cap has been irreplaceably removed, the discrete injection vial is still considered as being fit for administration as long as its injection vial stopper has not been punctured. Accordingly, the liquid drug transfer devices with an integral telescopic vial adapter of the present invention enable a pre-attached non-punctured intact discrete injection vial to be detached therefrom by means of an intact discrete injection vial release tool with an opposite pair of inward directed protrusions for applying a pincers-like compression. The intact discrete injection vial release tool can be configured as a pincers-like hand tool. Alternatively, the intact discrete injection vial release tool can be configured as a user operated electromechanical apparatus. The use of an intact discrete injection vial release tool for detachment of an intact discrete injection vial from an unused RTU liquid drug transfer assemblage affords that authorized healthcare providers only can detach same for use with a new liquid drug transfer device for preparing a new RTU liquid drug transfer assemblage.

BRIEF DESCRIPTION OF DRAWINGS

In order to understand the invention and to see how it can be carried out in practice, preferred embodiments will now be described, by way of non-limiting examples only, with reference to the accompanying drawings in which similar parts are likewise numbered, and in which.

DETAILED DESCRIPTION OF PREFERRED EMBODIMENT OF THE INVENTION

Figure 1:
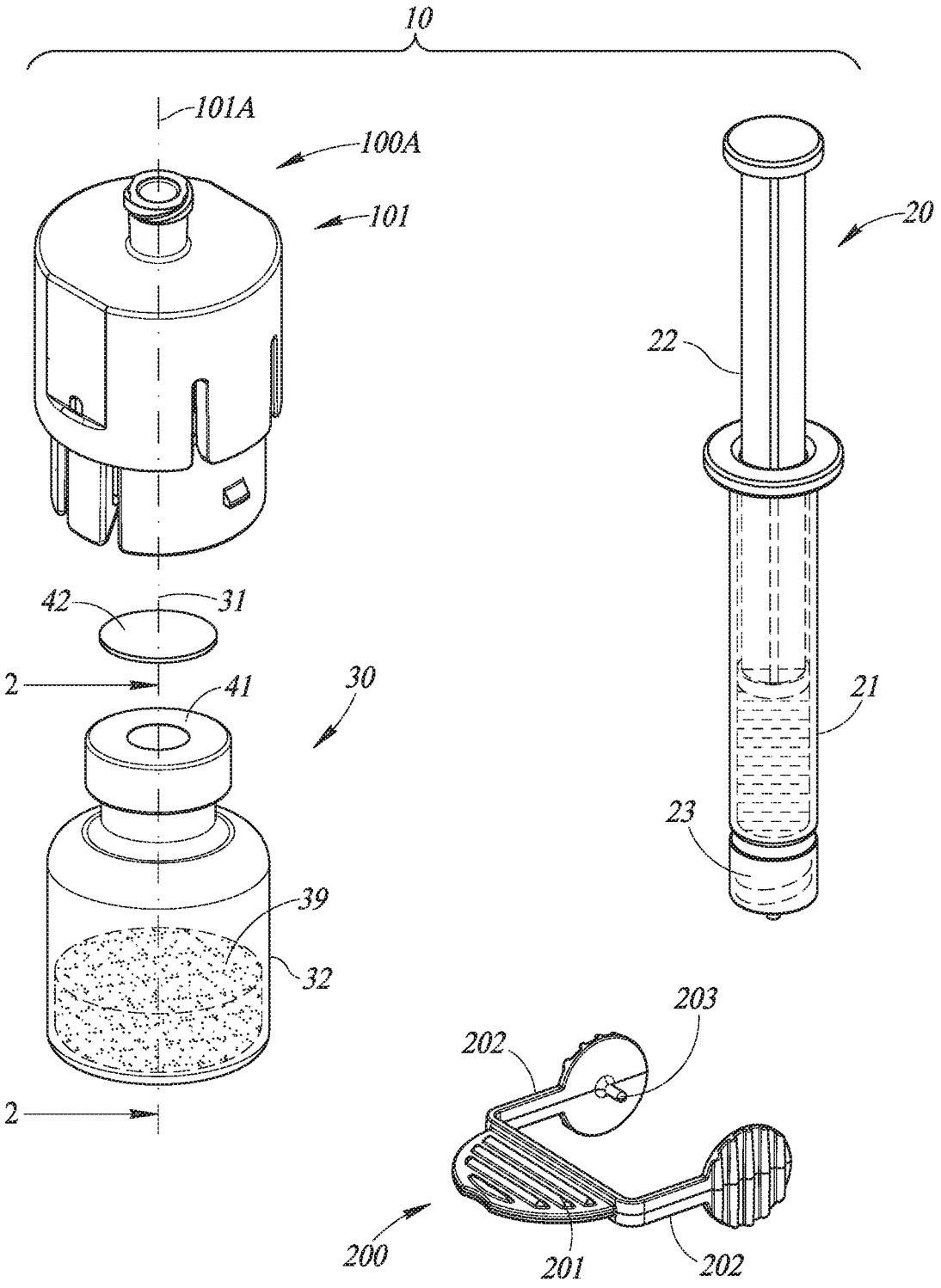
FIG. 1 is a pictorial view of an administration set including a telescopic female vial adapter, a discrete injection vial, a needleless syringe and a pincers-like hand tool for releasing an intact discrete injection vial from the telescopic female vial adapter.

FIG. 1 shows an administration set 10 including a needleless syringe 20, an initially non-punctured intact discrete injection vial 30, a liquid drug transfer device 100A configured as a telescopic female vial adapter and an intact discrete injection vial release tool 200 for releasing the non-punctured intact discrete injection vial 30 from the liquid drug transfer device 100A.

FIG. 1 shows the needleless syringe 20 includes a syringe barrel 21 with a plunger rod 22 and a male connector 23. The male connector 23 is preferably a male Luer lock connector. The needleless syringe 20 contains liquid contents. The liquid contents are typically diluent only. The liquid contents can include an active ingredient.

Figure 2:
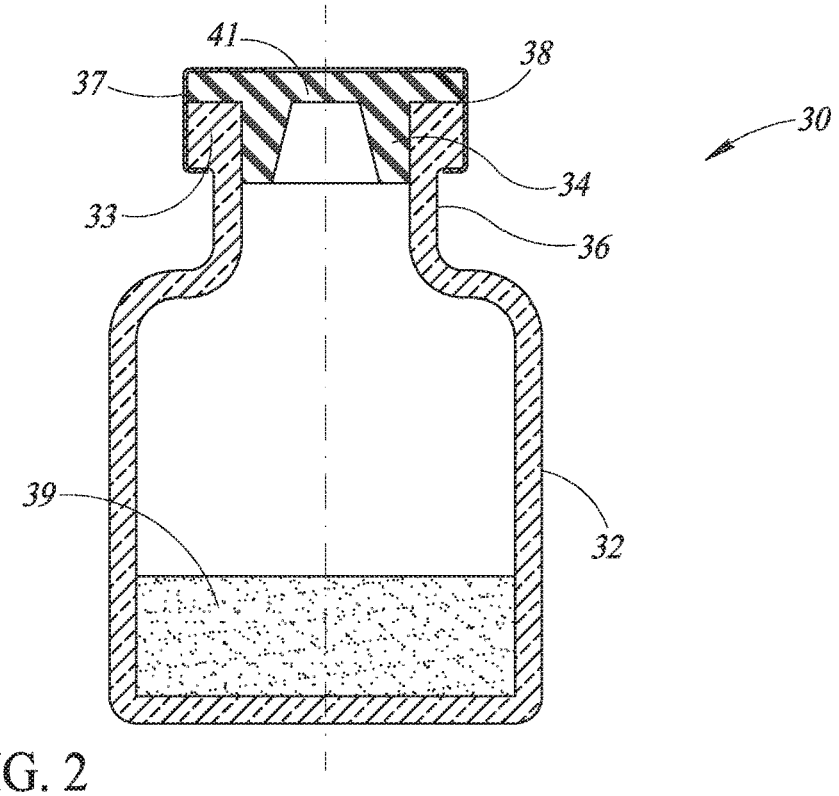
FIG. 2 is a longitudinal cross section of the discrete injection vial along a cross section line 2-2 in FIG. 1.
Figure 3:
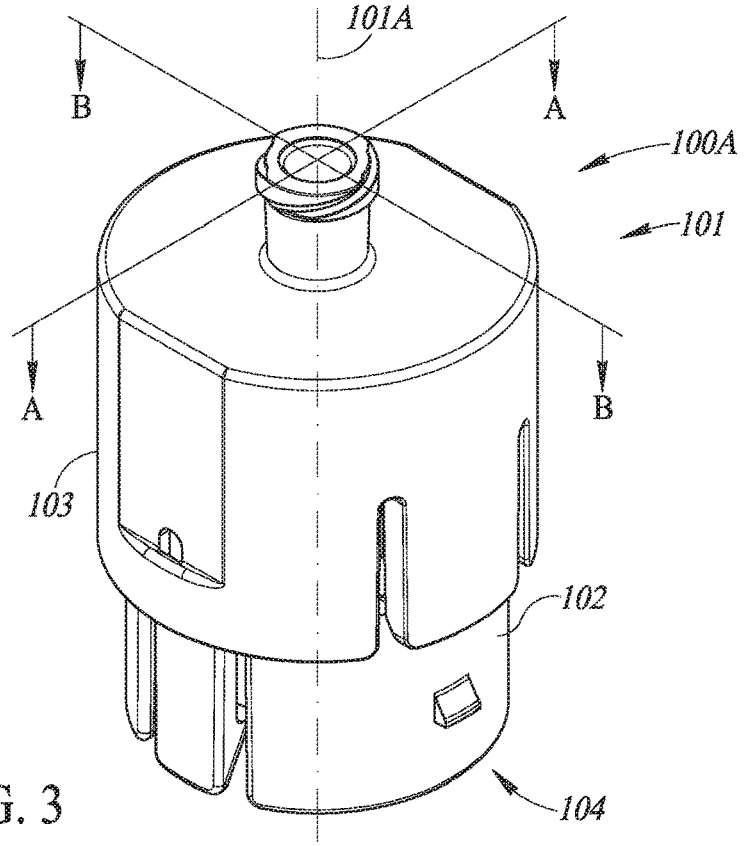
FIG. 3 is a front perspective view of the telescopic female vial adapter in its pre-compacted state.

FIG. 1 and FIG. 2 show the injection vial 30 has a longitudinal injection vial centerline 31 and includes a closed end vial tube 32, a tubular vial crown 33 having a crown opening 34 and a vial neck 36 intermediate the vial tube 32 and the vial crown 33. The discrete injection vial 30 includes an injection vial stopper 37 for hermetically sealing the crown opening 34. The vial crown 33 is capped by a band 38. The injection vial 30 contains a medicament 39 in the form of powder, liquid, and the like. The medicament 39 together with the syringe's liquid contents form a liquid drug. The injection vial 30 has an uppermost injection vial surface 41 which is sterilized before accessing the injection vial 30 for forming a liquid drug. The injection vial 30 includes a flip-off tamper evidence cap 42 which is removed immediately before use to expose the uppermost injection vial surface 41. The tamper evidence cap 42 is intended to be single use such that it cannot be replaced after removal.

FIG. 1 shows the intact discrete injection vial release tool 200 configured as a pincers-like hand tool including a pincers-like body 201 with an opposite pair of jaws 202 each terminating at an inward directed protrusion 203. The opposite jaws 202 are intended to be manually urged towards one another for applying a pincers-like compression for releasing a non-punctured intact discrete injection vial 30 as described hereinbelow with reference to FIG. 7 and FIG. 8.

FIG. 3 to FIG. 10 show the liquid drug transfer device 100A includes an integral telescopic vial adapter 101 having a longitudinal vial adapter centerline 101A. The integral telescopic vial adapter 101 includes an inner vial adapter body 102, an outer vial adapter body 103 and a clamping arrangement 104 for irreversibly clamping the vial adapter 101 in a compacted state.

The inner vial adapter body 102 has an inverted cup shape with an uppermost transverse annular inner vial adapter body wall 106 and a downward depending vial crown sleeve 107 with a lowermost vial crown sleeve rim 107A. The inner vial adapter body 102 bounds a vial crown cavity 108 for snugly receiving the vial crown 33 therein on telescopically snap fitting the inner vial adapter body 102 thereon. The uppermost transverse annular inner vial adapter body wall 106 has a center uppermost transverse inner vial adapter body wall throughgoing aperture 106A along the longitudinal vial adapter centerline 101A overlying the uppermost injection vial surface 41 on telescopically snap fitting on the discrete injection vial 30.

The vial crown sleeve 107 has a major vial crown sleeve surround 109 with a first adjacent pair of longitudinal slits 111A and a second adjacent pair of longitudinal slits 111B for correspondingly forming a diametric pair of vial crown holding members 112A and 112B. The diametric pair of vial crown holding members 112 are pivotal with respect to the major vial crown sleeve surround 109 such that each vial crown holding member 112 has a proximal vial crown holding member section 113 and a distal vial crown holding member section 114. The uppermost transverse annular inner vial adapter body wall 106 preferably has a diametric pair of throughgoing cutouts 116 inward of the diametric pair of vial crown holding members 112 such that the diametric pair of vial crown holding members 112 pivot on the uppermost transverse annular inner vial adapter body wall 106. The distal vial crown holding member sections 114 each have a radial inward vial crown holding projection 117 toward the lowermost vial crown sleeve rim 107A for snap fitting under the vial crown 33 on telescopically snap fitting the inner vial adapter body 102 on the initially non-punctured intact discrete injection vial 30.

The uppermost transverse annular inner vial adapter body wall 106 includes a diametric pair of upright stops 118A and 118B correspondingly orthogonal to the diametric pair of vial crown holding members 112A and 112B. The vial crown sleeve 107 includes a diametric pair of clamp members 119A and 119B towards the lowermost vial crown sleeve rim 107A and correspondingly orthogonal to the diametric pair of vial crown holding members 112A and 112B. The diametric pair of clamp members 119 constitute a component of the clamping arrangement 104.

The outer vial adapter body 103 has an inverted cup shape with an uppermost transverse outer vial adapter body wall 121 and a downward depending skirt 122. The outer vial adapter body 103 bounds an inner vial adapter body cavity 123 for snugly telescopically receiving the inner vial adapter body 102 therein on compacting the vial adapter 101 from a pre-compacted state to a compacted state. The downward depending skirt 122 has a lowermost skirt rim 122A.

The uppermost transverse outer vial adapter body wall 121 has a downward depending puncturing cannula 124 with a proximal puncturing cannula opening 124A and a distal puncturing cannula tip 124B for puncturing the injection vial stopper 37 for flow communication with the vial tube 32. The uppermost transverse outer vial adapter body wall 121 has an upright liquid transfer port 125 in flow communication with the proximal puncturing cannula opening 124A. The upright liquid transfer port 125 is configured as a female connector for use with the needleless syringe 20. The female connector 125 is preferably configured as a female Luer connector.

The downward depending skirt 122 includes a first adjacent pair of longitudinal slits 126A and a second adjacent pair of longitudinal slits 126B for correspondingly forming a diametric pair of inner vial adapter body holding members 127A and 127B. The diametric pair of inner vial adapter body holding members 127A and 127B correspondingly include internal longitudinal recesses 128A and 128B. The diametric pair of inner vial adapter body holding members 127 with their internal longitudinal recesses 128 constitute a component of the clamping arrangement 104. The diametric pair of internal longitudinal recesses 128A and 128B correspondingly include a diametric pair of lowermost recess rims 129A and 129B. The downward depending skirt 122 includes a diametric pair of throughgoing discrete injection vial release apertures 131A and 131B orthogonal to the diametric pair of inner vial adapter body holding members 127A and 127B.

Figure 6:
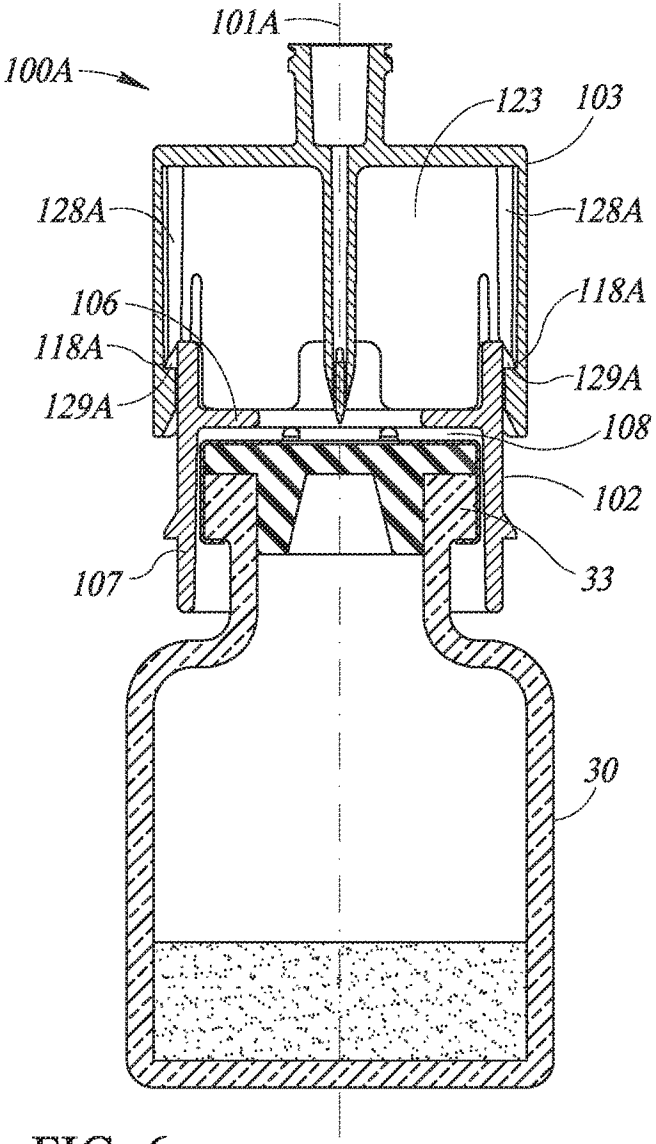
FIG. 6 is a longitudinal cross section of the telescopic female vial adapter in its pre-compacted state telescopically snap fitted on the non-punctured intact discrete injection vial along a cross section line B-B in FIG. 3.
Figure 5:
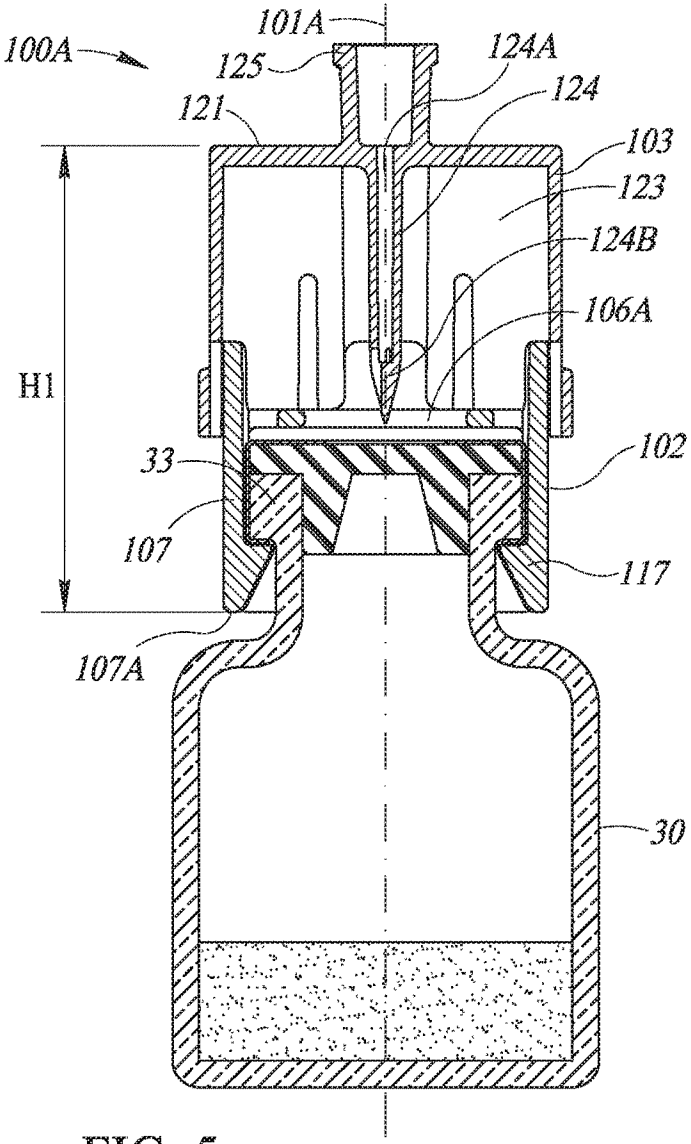
FIG. 5 is a longitudinal cross section of the telescopic female vial adapter in its pre-compacted state telescopically snap fitted on the non-punctured intact discrete injection vial along a cross section line A-A in FIG. 3.

FIG. 5 and FIG. 6 show that in the initial pre-compacted state, the diametric pair of upright stops 118 are disposed at the diametric pair of lowermost recess rims 129 for preventing the inner vial adapter body 102 being inadvertently removed from the outer vial adapter body 103. The distal puncturing cannula tip 124B overlies the non-punctured injection vial stopper 37. The diametric pair of proximal vial crown holding member sections 113 is aligned with the diametric pair of throughgoing discrete injection vial release apertures 131. The vial adapter 101 has a pre-compacted height H1 between the uppermost transverse outer vial adapter body wall 121 and the lowermost downward depending vial crown sleeve rim 107A.

Figure 8:
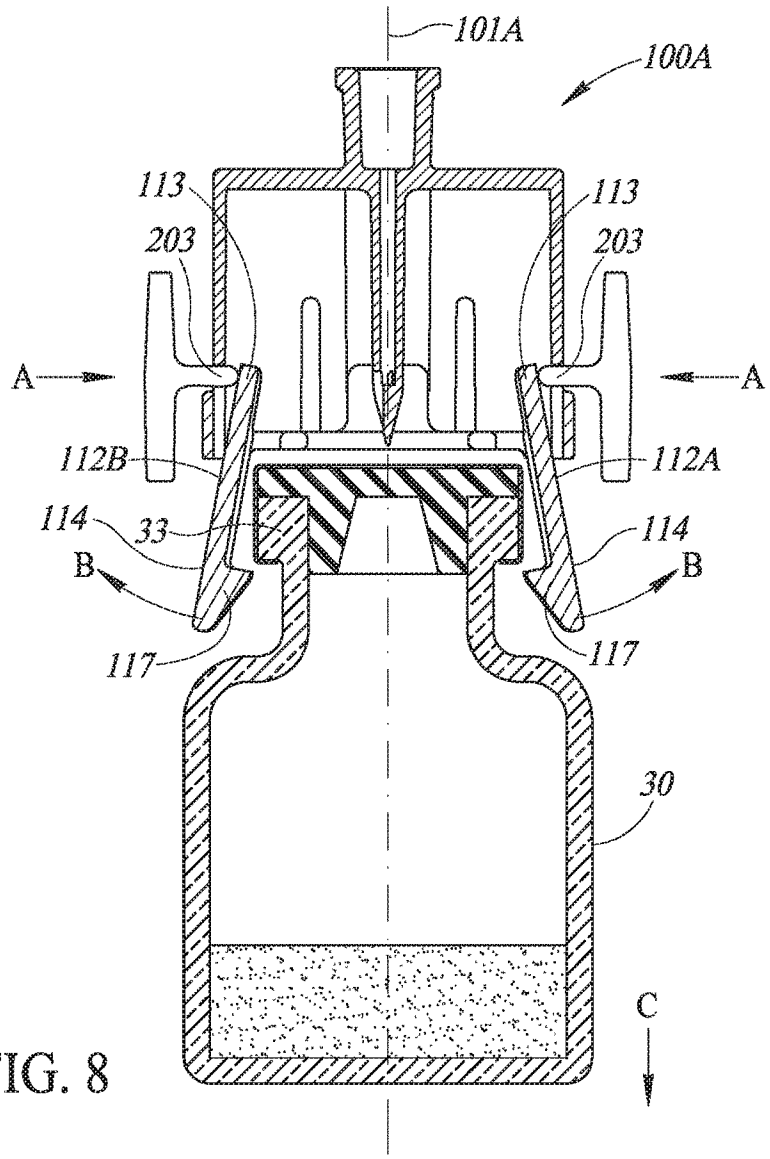
FIG. 8 is a longitudinal cross section showing the use of the pincers-like hand tool for releasing the non-punctured intact discrete injection vial along a cross section line C-C in FIG. 7.
Figure 7:
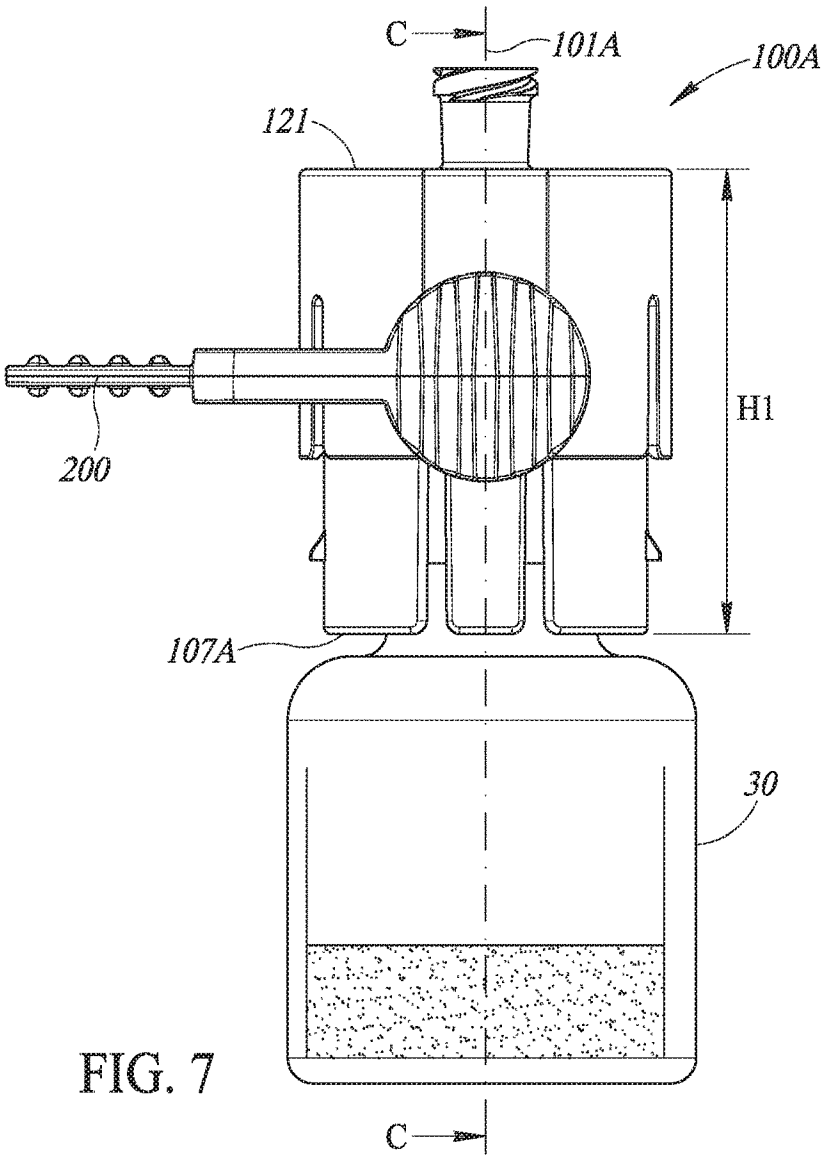
FIG. 7 is a front elevation view showing the use of the pincers-like hand tool in the pre-compacted state for releasing the non-punctured intact discrete injection vial.

In the event it is decided not to administer the medicament and re-use the non-punctured intact discrete injection vial 30, a healthcare provider takes the following steps as shown in FIG. 7 and FIG. 8: the healthcare provider aligns the pincers-like hand tool 200 with the vial adapter 101 for inserting its opposite pair of inward directed protrusions 203 through the diametric pair of throughgoing discrete injection vial release apertures 131. The healthcare provider applies a pincers-like compression on the diametric pair of proximal vial crown holding member sections 113 for urging them towards the longitudinal vial adapter centerline 101A as denoted by arrows A. The diametric pair of vial crown holding members 112 pivot with respect to the major vial crown sleeve surround 109 thereby distancing the diametric pair of radial inward vial crown holding protrusions 117 away from the longitudinal vial adapter centerline 101A as denoted by arrows B to release the non-punctured intact discrete injection vial 30. The healthcare provider withdraws the non-punctured intact discrete injection vial 30 from the inner vial adapter body 102 as denoted by arrow C.

Figure 10:
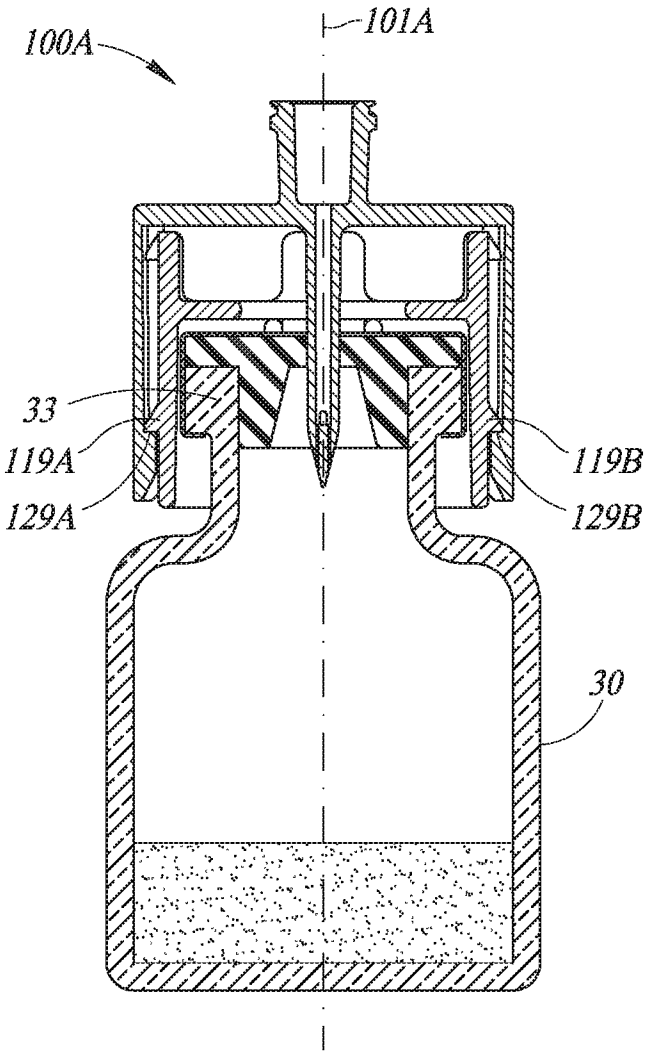
FIG. 10 is a longitudinal cross section of the telescopic female vial adapter in its compacted state puncturing the discrete injection vial along the cross section line B-B in FIG. 3.
Figure 9:
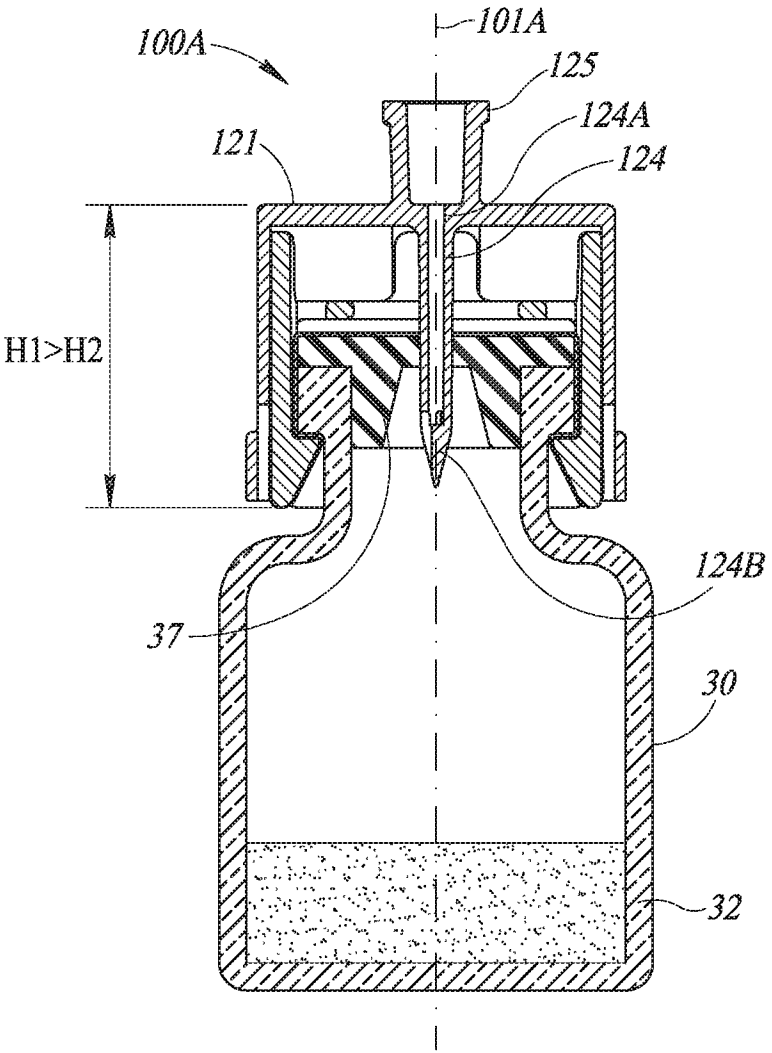
FIG. 9 is a longitudinal cross section of the telescopic female vial adapter in its compacted state puncturing the discrete injection vial along the cross section line A-A in FIG. 3.

FIG. 9 and FIG. 10 show that in the final compacted state, the diametric pair of clamp members 119 are disposed at the diametric pair of lowermost recess rims 129 for preventing the telescopic vial adapter 101 being reverted to its pre-compacted state. The distal puncturing cannula tip 124B punctures through the injection vial stopper 37 thereby providing flow communication between the upright female Luer connector 125 and the vial tube 32. The diametric pair of proximal vial crown holding member sections 113 are disposed between the uppermost transverse outer vial adapter body wall 121 and the diametric pair of throughgoing discrete injection vial release apertures 131 thereby precluding access thereto for applying the pincers-like compression. The vial adapter 101 has a compacted height H2 equal to the outer vial adapter body 103's height on complete telescopic insertion of the inner vial adapter body 102 therein where $H2<H1$.

In the final compacted state, the healthcare provider can screw thread the needleless syringe 20 to the female Luer connector 125 for introducing its liquid contents into the discrete injection vial 30 for forming a liquid drug therein. Thereafter, the healthcare provider can aspirate the liquid drug from the discrete injection vial 30 for administration purposes.

Figure 11:
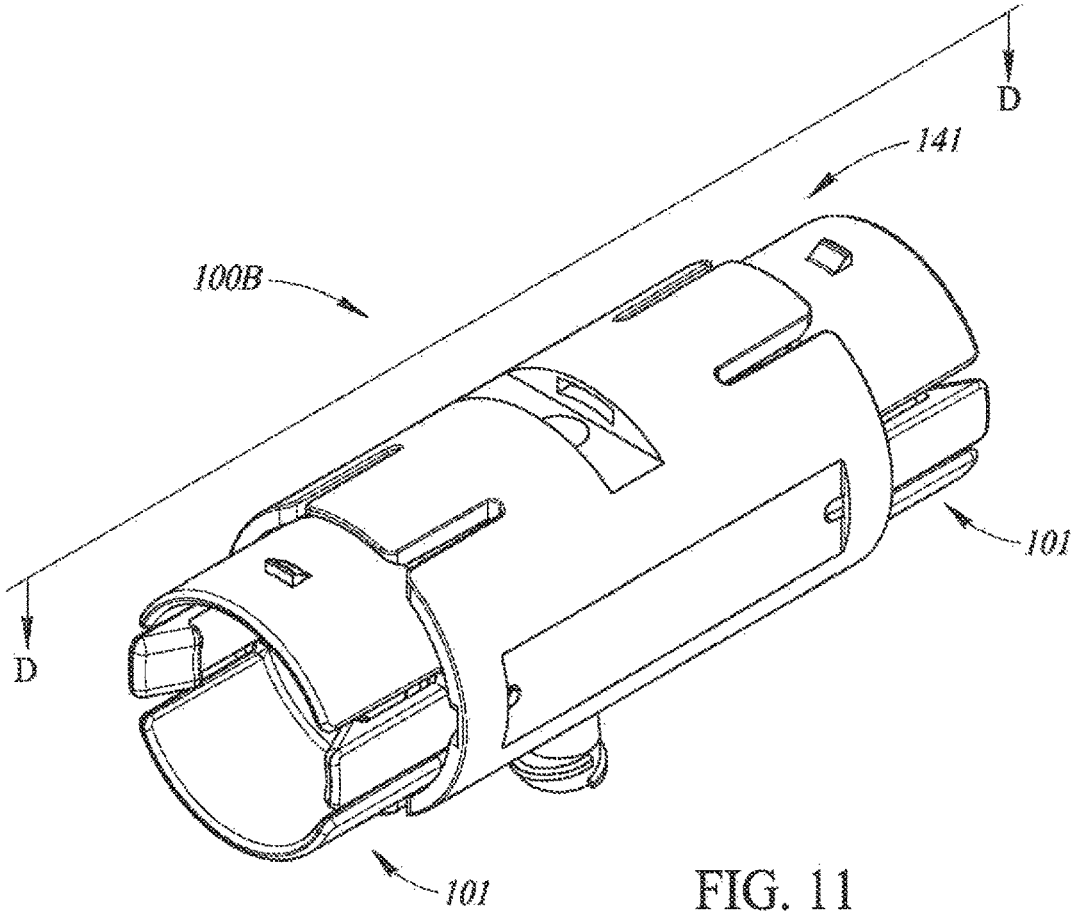
FIG. 11 is a front perspective view of a liquid drug transfer device configured for use with a pair of initially non-punctured intact discrete injection vials and a needleless syringe.
Figure 12:
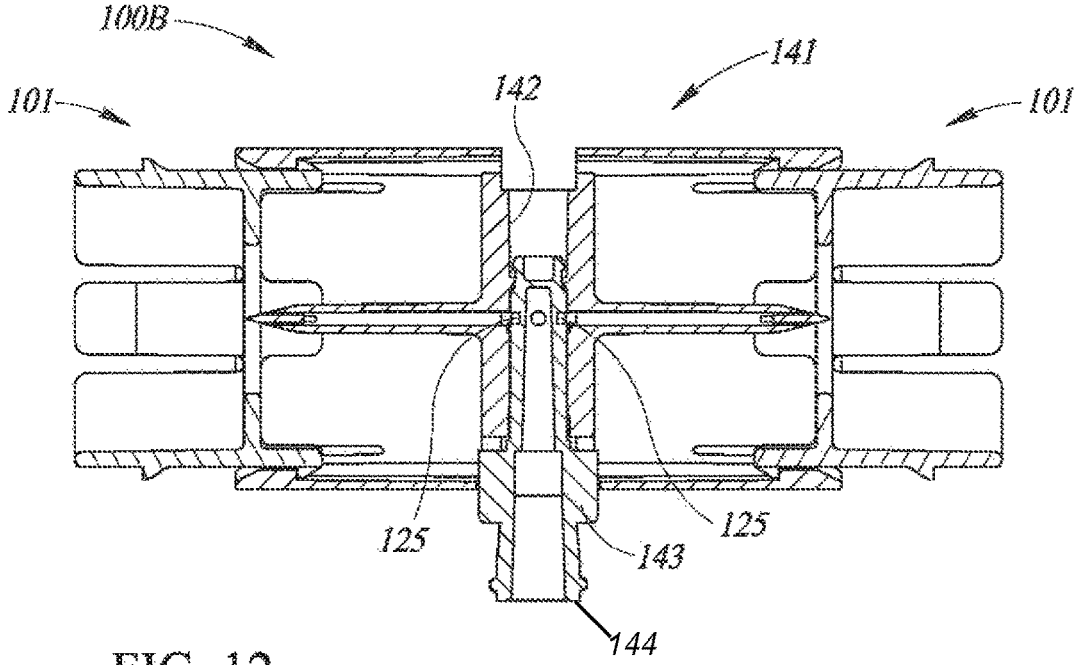
FIG. 12 is a longitudinal cross section of the FIG. 11 liquid drug transfer device along a cross section line D-D in FIG. 11.

FIG. 11 and FIG. 12 show a liquid drug transfer device 100B similar in construction as commonly owned U.S. Pat. No. 6,379,340 to Zinger et al. hereinafter referred to as the Zinger device. The Zinger device is used with a pair of injection vials and an initially empty needleless syringe. One injection vial includes liquid contents (hereinafter referred to as the liquid vial) and the other injection vial includes a medicament under negative pressure (hereinafter referred to as the drug vial). The Zinger device has a longitudinal housing with a central flow control member port and a lateral pair of vial adapters. The flow control member port includes a flow control member having a syringe port for screw thread attachment of the needleless syringe. The flow control member is rotatable by the syringe port from a first operative position for enabling flow communication between the vial adapters and a second operative position for enabling flow communication between a vial adapter and the syringe port.

The Zinger Instructions For Use (IFU) are follows: the liquid vial is initially inserted in one vial adapter and the drug vial is subsequently inserted in the other vial adapter. The drug vial draws the liquid contents from the liquid vial thereinto to form a liquid drug. The initially empty needleless syringe is connected to the syringe port which is rotated through a quarter turn to enable aspiration of the liquid drug from the drug vial into the needleless syringe. The needleless syringe is detached from the Zinger device for administration of the liquid drug.

The liquid drug transfer device 100B includes an elongated housing 141 having a central flow control member port 142 and a lateral pair of integral telescopic vial adapters 101. The liquid drug transfer device 100B includes a flow control member 143 having a syringe port 144 rotatably mounted in the flow control member port 142. The integral telescopic vial adapters 101 each have a liquid transfer port 125 in flow connection with the central flow control member port 142. The use of the liquid drug transfer device 100B is the same as the Zinger device except that the latter 100B enables preparation of a RTU liquid drug assemblage and release of a non-punctured intact discrete injection vial.

Figure 13:
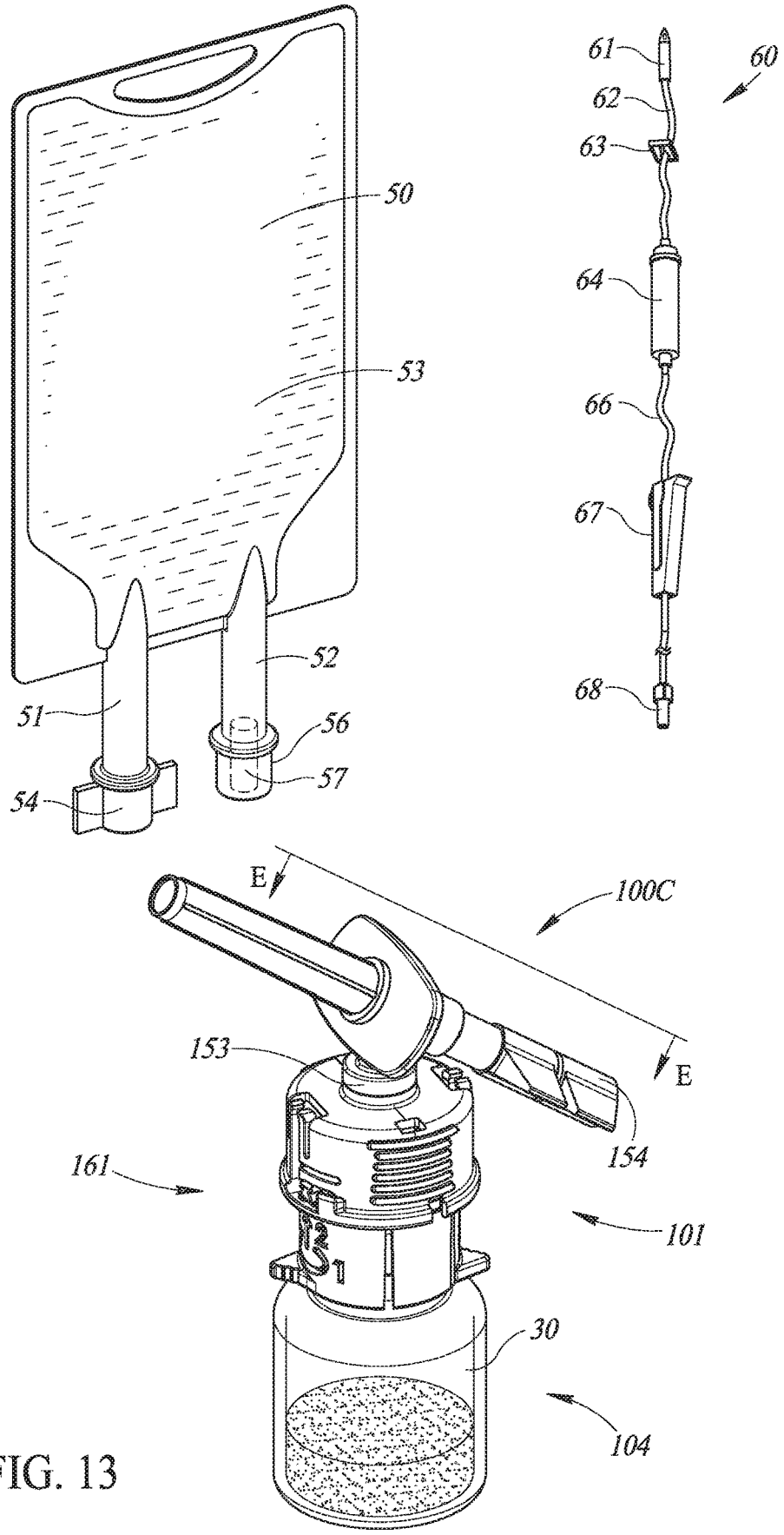
FIG. 13 is a pictorial view of a liquid drug transfer device for use with an infusion liquid container and an infusion set.
Figure 14:
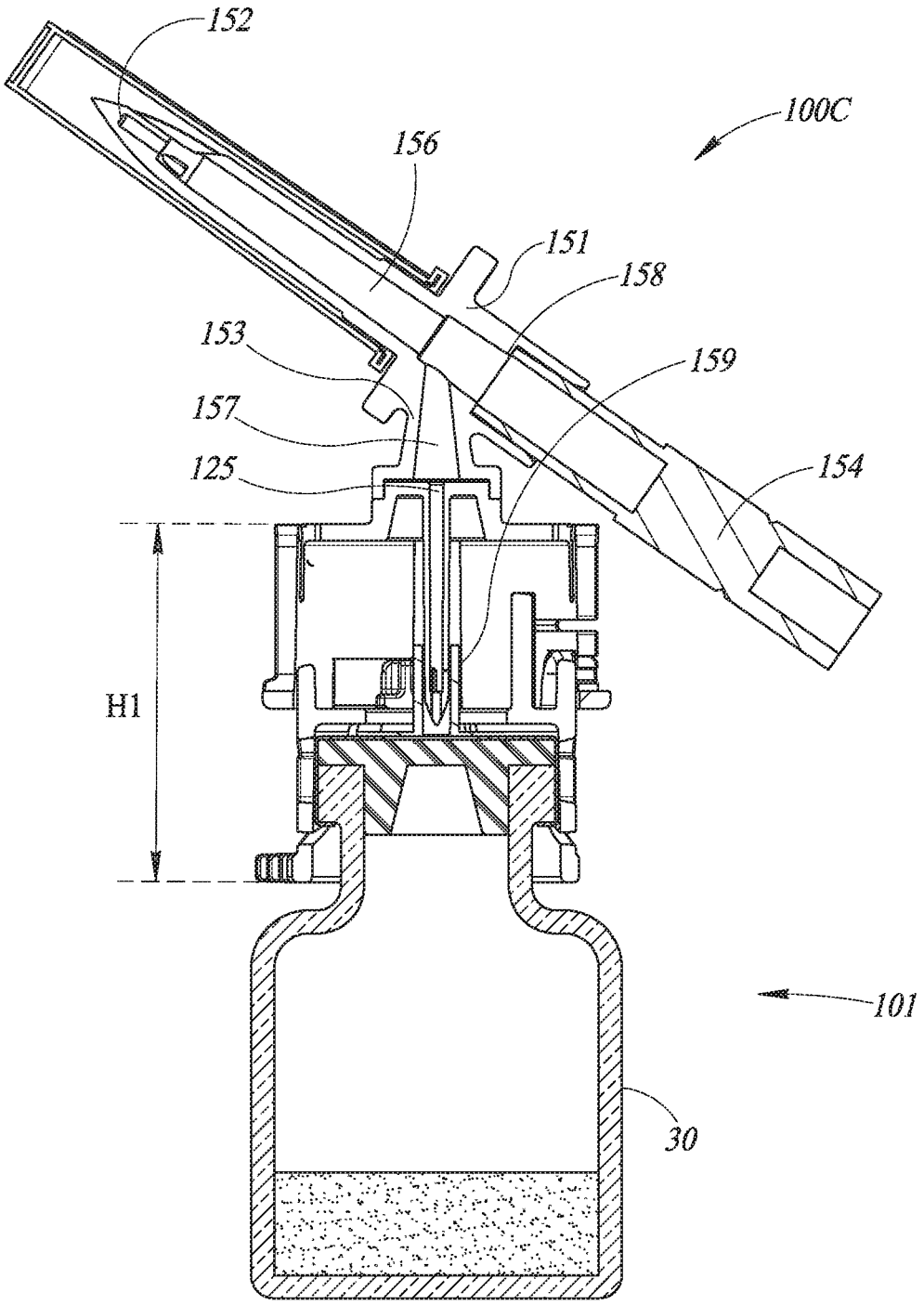
FIG. 14 is a longitudinal cross section of the FIG. 13 liquid drug transfer device along a cross section line E-E in FIG. 13.

FIG. 13 and FIG. 14 show a liquid drug transfer device 100C for use with an infusion liquid container and an infusion set. The infusion liquid container 50 is constituted by an intravenous (IV) bag having an IV or administration port 51 and an injection port 52 and containing an infusion liquid 53. The IV port 51 is sealed by a twist-off cap 54 for insertion of an IV spike for administration purposes. The injection port 52 terminates in an injection port tip 56 with a seal-sealing plug 57 intended for needle insertion of syringe contents into the IV bag 50. The infusion set 60 includes an IV spike 61 and additionally includes first tubing 62, a clamp 63, a drip chamber 64, second tubing 66, a roller clamp 67, and a male Luer connector 68.

Figure 4A:
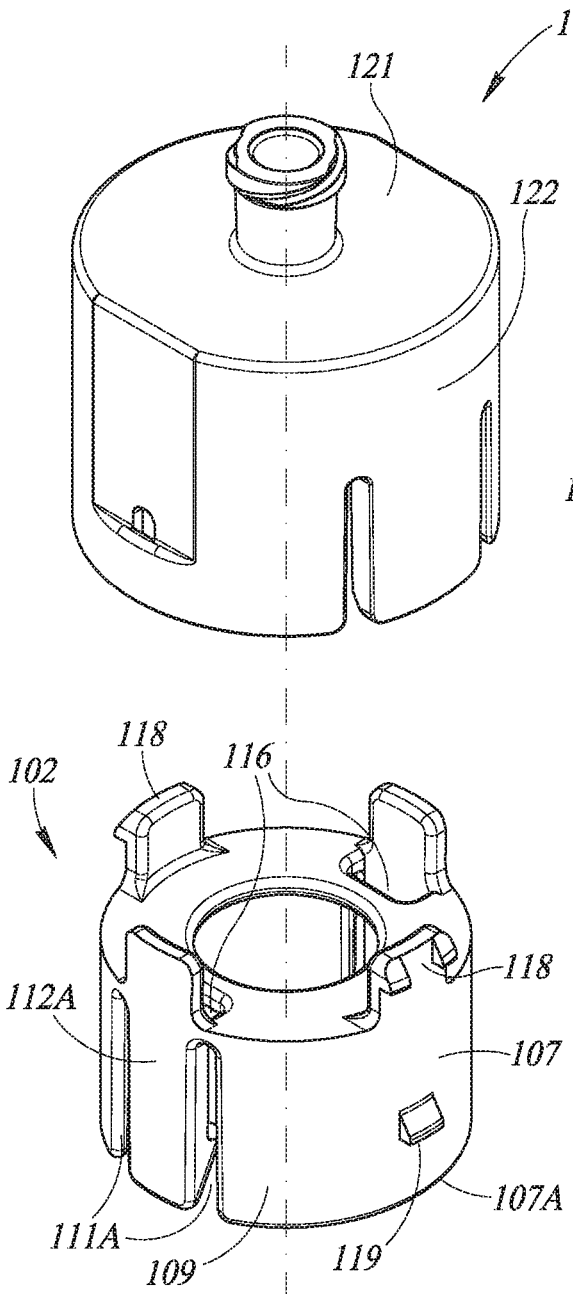
FIG. 4A is an exploded top perspective view of the telescopic female vial adapter.
Figure 4B:
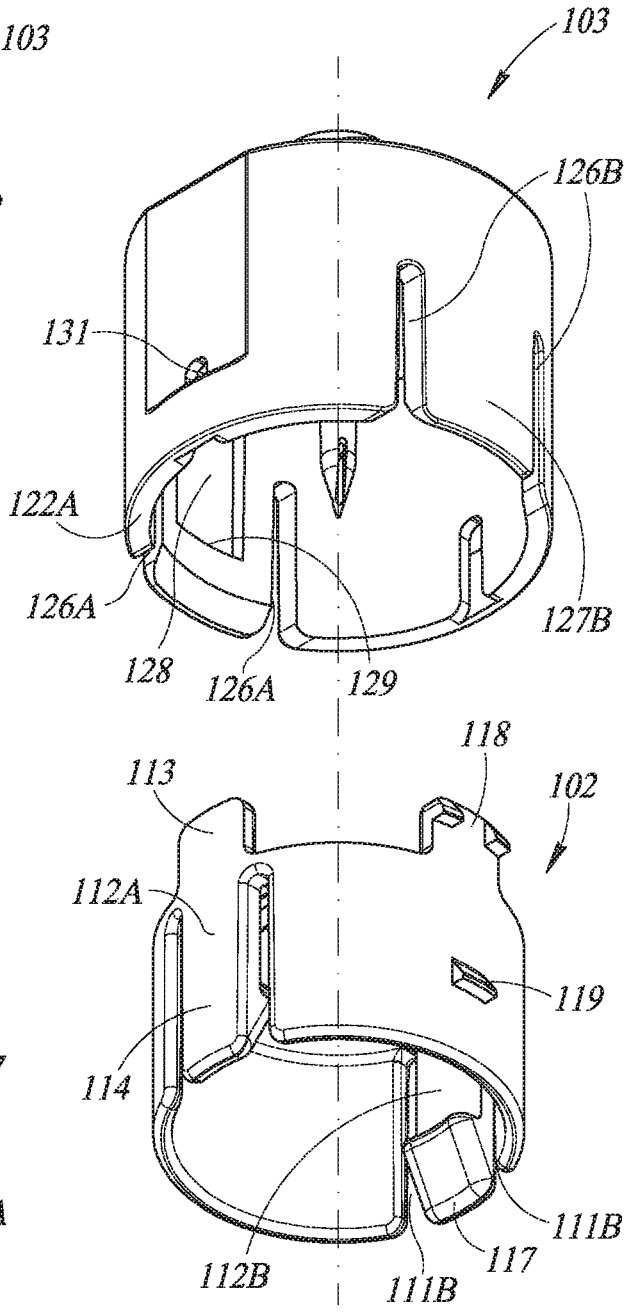
FIG. 4B is an exploded bottom perspective view of the telescopic female vial adapter.

The liquid drug transfer device 100C is similar in construction as the liquid transfer device disclosed in commonly owned US Patent Application Publication No. US 2016/0166824 to Lev et al. FIG. 4 and FIG. 5 hereinafter referred to as the Lev device. The Lev device includes a trifurcated Y-shaped connector body having an IV spike for sealing insertion into the IV port 51, a vial adapter port, and a twist-off substitute IV port. The vial adapter port has an integral vial adapter with a puncturing cannula. The connector body has a lumen terminating at the IV spike, a lumen in flow communication with the puncturing cannula and a lumen terminating at the substitute IV port. The three lumens are in three way direct and continuous fluid connection. The substitute IV port is formed from suitable flexible plastic material, for example, PVC, and the like, for sealing receiving the IV spike 61. The substitute IV port includes a septum intended to be punctured on insertion of the IV spike 61. The substitute IV port includes a proximal section and a distal section. In use, the distal section is twisted and broken off from the proximal section thereby exposing the septum for puncturing by the infusion set's IV spike 61.

The liquid drug transfer device 100C includes a trifurcated Y-shaped connector body 151 having an IV spike 152 for sealing insertion into the IV port 51, a vial adapter port 153, and a twist-off substitute IV port 154. The vial adapter port 153 has an integral telescopic vial adapter 101. The connector body 151 has a lumen 156 terminating at the IV spike 152, a lumen 157 in flow communication with the integral telescopic vial adapter 101 and a lumen 158 terminating at the substitute IV port 154. The three lumens 156, 157 and 158 are in three way direct and continuous fluid connection.

The integral telescopic vial adapter 101 has a liquid transfer port 125 in flow connection with the vial adapter port 153. The integral telescopic vial adapter 101 preferably includes a sealing member 159 mounted on the puncturing cannula 124 for maintaining sterility of the distal puncturing cannula tip 124B and extending the length of time that a RTU liquid drug transfer assemblage can be used. The integral telescopic vial adapter 101 preferably also includes a safety catch mechanism 161 for precluding inadvertent compaction from the pre-compacted state to the compacted state. The safety catch mechanism 161 requires a rotation action for rotating the inner vial adapter body 102 relative to the outer vial adapter body 103 for priming the integral telescopic vial adapter 101 ready for compaction.

The use of the liquid drug transfer device 100C is the same as the Lev device except that the latter 100C enables preparation of a RTU liquid drug assemblage and release of a non-punctured intact discrete injection vial 30.

While particular embodiments of the present invention are illustrated and described, it would be obvious to those skilled in the art that various other changes and modifications can be made without departing from the spirit and scope of the invention.

The invention claimed is:

1. A liquid drug transfer device for use with an initially non-punctured intact discrete injection vial having a closed end vial tube containing a medicament, a tubular vial crown having a crown opening stopped by a non-punctured injection vial stopper, and an uppermost injection vial surface, and an intact discrete injection vial release tool with an opposite pair of inward directed protrusions for applying a compression for releasing a non-punctured intact discrete injection vial from the liquid drug transfer device, the liquid drug transfer device comprising:

(a) an integral telescopic vial adapter having a longitudinal vial adapter centerline and including:

i) an inner vial adapter body having an inverted cup shape with an uppermost transverse annular inner vial adapter body wall and a downward depending vial crown sleeve having a lowermost vial crown sleeve rim, said inner vial adapter body bounding a vial crown cavity for receiving the vial crown on telescopically snap fitting said inner vial adapter body thereon, said vial crown sleeve having a major vial crown sleeve surround and a diametric pair of vial crown holding members pivotal with respect to said major vial crown sleeve surround such that each said vial crown holding member has a proximal vial crown holding member section and a distal vial crown holding member section, each said distal vial crown holding member section having a radial inward vial crown holding projection toward said lowermost vial crown sleeve rim for snap fitting under the vial crown on said telescopically snap fitting said inner vial adapter body on the initially non-punctured intact discrete injection vial, said diametric pair of vial crown holding members being pivotal with respect to said major vial crown sleeve surround such that application of the compression on said diametric pair of proximal vial crown holding member sections towards said longitudinal vial adapter centerline distances said diametric pair of radial inward vial crown holding projections from said longitudinal vial adapter centerline, and ii) an outer vial adapter body having an inverted cup shape with an uppermost transverse outer vial adapter body wall and a downward depending skirt, said outer vial adapter body bounding an inner vial adapter body cavity for snugly telescopically receiving said inner vial adapter body therein on compacting said integral telescopic vial adapter from an initial pre-compacted state having a pre-compacted height H1 to a final compacted state having a compacted height H2 where H1>H2, said uppermost transverse outer vial adapter body wall having a downward depending puncturing cannula with a proximal puncturing cannula opening and a distal puncturing cannula tip for puncturing the injection vial stopper for flow communication with the vial tube, and iii) a clamping arrangement for irreversibly clamping said vial adapter in said final compacted state, said vial adapter being configured such that in said pre-compacted state, said distal puncturing cannula tip overlies the non-punctured injection vial stopper and said diametric pair of proximal vial crown holding member sections are accessible for said compression for releasing the non-punctured intact discrete injection vial from said inner vial adapter body, and in said final compacted state, said distal puncturing cannula tip punctures through said injection vial stopper for flow communication with the vial tube and said downward depending skirt precludes access to said diametric pair of proximal vial crown holding member sections; and b) a liquid transfer port in flow communication with said proximal puncturing cannula opening.

2. The device according to claim 1 wherein said downward depending skirt includes a diametric pair of throughgoing discrete injection vial release apertures shaped and dimensioned for providing access to the intact discrete injection vial release tool for applying said compression to said diametric pair of proximal vial crown holding member sections in said initial pre-compacted state of said vial adapter.

3. The device according to claim 1 wherein said diametric pair of vial crown holding members pivot on said uppermost transverse annular inner vial adapter body wall on said application of the compression.

4. The device according to claim 1 wherein said integral telescopic vial adapter includes a safety catch mechanism requiring a release action for enabling compaction of said integral telescopic vial adapter from said pre-compacted state to said compacted state.

5. The device according to claim 1 configured as a vial adapter and said liquid transfer port is a connector.

6. The device according to claim 1 configured for use with a pair of initially non-punctured intact discrete injection vials and a needleless syringe.

7. The device according to claim 1 configured for use with an infusion liquid container and an infusion set.

8. The intact discrete injection vial release tool with the opposite pair of inward directed protrusions for use with the device according to claim 1 being configured as a hand tool having an opposite pair of jaws with the opposite pair of inward directed protrusions.

* * * * *